US006658864B2

(12) United States Patent
Thomas et al.

(10) Patent No.: US 6,658,864 B2
(45) Date of Patent: Dec. 9, 2003

(54) CRYOGENIC COOLING SYSTEM APPARATUS AND METHOD

(76) Inventors: Michael Thomas, 14627 N. Amber La., Effingham, IL (US) 62401; Lonnie Randolph, 27 Ct. Six, Effingham, IL (US) 62401; Greg Brandt, 16727 N. 500th Rd., Wheeler, IL (US) 62479; Chris Gieseking, 75 Wilderness La., Defiance, MO (US) 63341-2402; Dave Winship, 7970 N. 600th St., Altamont, IL (US) 62411

( * ) Notice: Subject to any disclaimer, the term of this patent is extended or adjusted under 35 U.S.C. 154(b) by 0 days.

(21) Appl. No.: 10/173,057

(22) Filed: Jun. 17, 2002

(65) Prior Publication Data

US 2003/0029176 A1 Feb. 13, 2003

Related U.S. Application Data

(60) Provisional application No. 60/298,856, filed on Jun. 15, 2001, provisional application No. 60/298,851, filed on Jun. 15, 2001, provisional application No. 60/299,131, filed on Jun. 15, 2001, provisional application No. 60/298,854, filed on Jun. 15, 2001, and provisional application No. 60/298,852, filed on Jun. 15, 2001.

(51) Int. Cl.[7] ..... F25D 25/00; F25D 13/06; B29C 53/00; B29C 47/12; B29C 47/00

(52) U.S. Cl. ..... 62/63; 62/380; 264/148; 264/177.19

(58) Field of Search ..... 62/63, 380, 177, 62/186; 264/237, 148, 177.19

(56) References Cited

U.S. PATENT DOCUMENTS

| | | | | | |
|---|---|---|---|---|---|
| 4,321,801 | A | * | 3/1982 | Collard, Jr. | 62/238.4 |
| 4,755,118 | A | * | 7/1988 | Ondush et al. | 425/71 |
| 4,860,565 | A | * | 8/1989 | Kato et al. | 72/38 |
| 4,931,232 | A | * | 6/1990 | Lermuzeaux et al. | 264/28 |
| 6,363,730 | B1 | * | 4/2002 | Thomas et al. | 62/62 |
| 6,389,828 | B1 | * | 5/2002 | Thomas | 62/186 |
| 2002/0174663 | A1 | * | 11/2002 | Hutchinson et al. | 62/62 |

* cited by examiner

*Primary Examiner*—William C. Doerrler
(74) *Attorney, Agent, or Firm*—Barnes & Thornburg

(57) ABSTRACT

A method and apparatus for using a cryogen for cooling articles, particularly having applications for chilling extrusions, food, and similar articles, utilizing dispersion of liquid cryogen into a feed chamber wherein it is substantially vaporized and then circulated through a cooling chamber containing the article to be cooled. A circulation device can circulate the vaporized cryogen through the cooling chamber, or through the article, at a variably controllable velocity to enhance the cooling efficiency using the principle of forced air convection and to provide improved temperature control in the system.

72 Claims, 10 Drawing Sheets

CRYOGENIC COOLING SYSTEM APPARATUS AND METHOD

This application claims the benefit of U.S. Provisional Application Ser. No. 60/298,856 filed Jun. 15, 2001, U.S. Provisional Application Ser. No. 60/298,851 filed Jun. 15, 2001, U.S. Provisional Application Ser. No. 60/299,131 filed Jun. 15, 2001, U.S. Provisional Application Ser. No. 60/298,854 filed Jun. 15, 2001, and U.S. Provisional Application Ser. No. 60/298,852 filed Jun. 15, 2001.

FIELD OF THE INVENTION

The present invention relates generally to a method and apparatus for cooling extrusion articles, and more specifically to substantially vaporizing a liquid cryogen and then circulating the vaporized cryogen through a cooling chamber, through a cooling chamber including sizing and/or calibration tools, through a hollow in the article itself or a combination of the aforementioned to cool an extrudate. The invention is particularly useful as an extrusion chiller, and may also be utilized for chilling foods. Additionally, many other applications of the invention will become apparent to those skilled in the art upon a review of the following specification and drawings.

BACKGROUND OF THE INVENTION

Certain continuously extruded materials, e.g., rubber products, plastic products, metal products, wood composites, must be cooled after passing through the extrusion operation in order to prevent deformation. In conventional extrusion operations, the extruded materials, be it hose, pipe, rod, bar or any other shape may deform from its own weight if the temperature was not decreased rapidly after leaving the extruder. Cooling the product rapidly creates at least a minimum amount of rigidity in the extrudate such that the manufacturer can cut, stack or otherwise handle the extrudate without unwanted deformation. If the product is not cooled effectively and quickly, the resultant deformation can lead to excessive rates of rejection of the manufactured or extruded product. Further, the rate at which the extrudate is cooled directly affects the rate at which product may be produced. In other words, the faster an extrudate is cooled, the faster the end product can be produced.

Historically, cooling water systems have been utilized as the primary medium for cooling articles, including extrusions. For example, conventional extrusion chilling systems employ a "cooling" chamber downstream from the extruder. The extrusion is fed through the cooling chamber, wherein the extrusion can be sprayed with water, or partially/fully submerged in water in order to chill the extrusion. Various other components may also be included in such systems, such as a vacuum sizing chamber intermediate the extruder and the cooling chamber. The vacuum sizing chamber can be used for both solid and hollow extrusions and employs an external vacuum pump to create a vacuum to assist the extrusion in maintaining its shape while it cools. Water can also be used in the vacuum chamber to cool the extrusion while the vacuum supports the shape. However, cooling water systems have several drawbacks. Many products are adversely affected if contacted with water. Thus, extra care must be taken to avoid such occurrences. Extrusion speeds are limited because the cooling water generally has a well defined heat transfer capability and thus can only cool the fresh extrudate in accordance therewith. In practice, an optimum cooling temperature of approximately 50° F. is achievable from a cost-effective standpoint, which limits the manufacturer's ability to cool extrusions quickly. Additionally, cooling water systems require excessive floor space and also require treatments or special additive packages to prepare and maintain proper water chemistry, as well as to prevent scaling and bacterial growth, which add significantly to the cost thereof.

Coolant mediums other than water which have been used in cooling processes can be referred to collectively as refrigerants, including cryogens. Cryogens include liquid nitrogen, liquid carbon dioxide, liquid air and other refrigerants having normal boiling points substantially below minus 50° F. (−46° C.). Prior art methods of cooling articles using cryogens disclose the benefits of fully vaporizing a cryogen into a gaseous refrigerant prior to contact with the articles to be cooled. Cryogens due to their extremely low boiling point, naturally and virtually instantaneously expand into gaseous form when dispersed into the air. This results in a radical consumption of heat. The ambient temperature can be reduced to hundreds of degrees below zero (Fahrenheit) in a relatively short time, and much quicker than may be realized with a conventional cooling water system. The extreme difference in vaporized cryogen and the extruded product allows the manufacturer to quickly cool an extrudate.

However, prior methods of cryogenic cooling fail to realize the advantages, both in increased efficiency and in improved system control, that can be achieved by utilizing forced gas convection in combination with nitrogen or any other refrigerant. Some disadvantages of prior art cryogenic cooling systems include lower efficiency and limited options for controlling the cooling process. Such systems generally rely exclusively on the cooling effect of the refrigerant, to lower the ambient temperature and chill the article. Although prior art methods utilize forced convection to ensure complete vaporization of the cryogen, no methods use forced gas convection to control the rate of cooling of the article by controlling the wind chill temperature. Consequently, the only control variable in the prior art methods to adjust (lower) the temperature is the introduction of a liquid cryogen into the system. In contrast, utilization of forced gas convection adds a wide range of variable control to adjust the effective temperature, up or down, by controlling the velocity at which the refrigerant is circulated over/around the article to be cooled. Such a forced gas convection system is disclosed by Thomas in U.S. Pat. No. 6,389,828, incorporated herein in its entirety by reference thereto.

The basis of forced gas convection is the principle that increasing velocity of a refrigerant over a heated surface, such as by blowing, greatly enhances the transfer of heat from that surface. In the context of cold temperatures, this principle is probably better known indirectly from the commonly used phrase "wind chill" temperature, which is frequently reported on TV or radio by weather announcers. In that context, wind chill temperature is what the temperature outside "feels" like, taking into account the ambient temperature and the prevailing velocity of the wind. The stronger (higher velocity) the wind, the lower the temperature "feels," compared to if there were no wind present. Forced gas convection cooling systems, as disclosed herein, take advantage of this "wind chill" affect in their ability to remove heat from an object faster with a constant temperature of a gas. In other words, if a 400° F. object is placed in a constant 75° F. atmosphere without velocity of the surrounding atmosphere, the transfer of energy from the object to the surrounding atmosphere by convection is much slower than if the atmosphere has a velocity over/around the object. An increase in velocity will increase the rate of energy transfer, even though the temperature of the atmosphere is constant. The rate of cooling can be increased or decreased by manipulating the velocity of the cooling medium as the temperature of the medium remains constant. This principle is advantageously utilized to significantly enhance the cooling efficiency of the system by creating, and controlling, "wind chill" temperature during the cooling process. As a result, the efficiency of the process is increased while simultaneously reducing the size, which is typically the length, of the cooling system.

However, the previous method disclosed by Thomas utilizes only a measurement of the ambient temperature within the cooling chamber to adjust the velocity and discharge of cryogen. An extrudate leaving a cooling chamber does not necessarily need to be cooled to an even temperature throughout, but may rely on "equilibrium cooling." This principle is advantageously utilized according to the invention to significantly enhance the cooling efficiency of the system by creating and controlling the "wind chill" temperature during the cooling process in relation to a measurement of the temperature of the product after leaving the cooling chamber. The basis for "equilibrium cooling" is that a mass having two different temperature zones, or a temperature gradient, will exchange energy between the two zones until an "equilibrium" temperature is reached. Thus, a manufacturer can reduce cooling time and cooling system length by super-cooling at least 51% of the extrudate mass to form a "skin" having sufficient rigidity such that the extrudate may be handled as needed and then allowing the "equilibrium cooling" effect to take place after the extrudate has left the cooling system.

Another type of prior art cooling system utilizes a device called a "calibrator," and typically multiple such calibrators, to cool extrusions. A calibrator is a tool which generally has a central opening through which the extrusion is fed, the central opening having a surface which is generally in contact with the surface of the extrusion as it is fed through. As a result of contact with the surface of the extrusion, the calibrator acts as a heat sink and the heat is conducted to the calibrator and away from the extrusion thus cooling the extrusion. Since cooling of the extrudate tends to make the material contract or change shape, a vacuum generated by external vacuum pumps is generally drawn through grooves in the calibrator inner surface making contact with the extrudate. This vacuum assists in maintaining the shape of the extrudate. To enhance the heat transfer from the extrusion, internal passages or circuits are provided in the calibrator through which a coolant is circulated. Typically, the coolant is water, but liquid nitrogen is also known to have been used to some degree. However, circulating liquid nitrogen through the cooling circuits has met with some difficulties regarding contact of the liquid nitrogen with the calibrators. Additionally, cooling water systems include the inherent problems associated therewith as discussed above. The aforementioned U.S. Pat. No. 6,389,828 to Thomas discloses that it is preferable to first vaporize a liquid cryogen, such as liquid nitrogen, and then to circulate the super-cold vapor/refrigerant through the cooling circuits instead of the liquid cryogen, which thus requires a system for vaporizing the liquid cryogen prior to circulation through the cooling circuits of the calibrator. Although such a method is an improvement over the prior art, the system may still require the use of external vacuum pumps as previously stated. The present invention provides for a calibration tooling chamber utilizing forced-gas convection of a cryogenic refrigerant in combination with a calibrator tooling or sizing template having a plurality of fins in an outer surface thereof to allow the extrudate to be cooled at an effective rate. This eliminates the need for internal passages, and thus the additional manufacturing costs associated with the required set-up/connection/break-down of the equipment between different product runs. Further, the present invention, by use of a forced gas convection cooling chamber, provides a means of generating an internally induced vacuum to assist the extrudate without the requirement of a separate external pump. External vacuum pumps are expensive, require continued maintenance and repair, are noisy and they must be replaced often.

Many extruded articles include at least one hollow, such as pipe, hose, etc., or may contain several hollow portions. Prior art cooling systems provide the manufacturer with only the ability to cool an extrudate from an outer surface thereof by contact with a cooler medium (liquid, gas or solid depending on the system). Depending on the product geometry, however, a significant amount of an extrudate's mass may be positioned inward of the outer surface and between several hollow portions. Thus, it is difficult to quickly and effectively cool such an extrudate quickly because the cooling medium does not make contact with those portions. The present invention provides an apparatus and method for cooling an extrudate having at least one hollow by circulating a vaporized cryogen through the hollow, preferably in combination with exterior cooling techniques as disclosed in U.S. Pat. No. 6,389,828 and taught herein. This provides for increased cooling capacity and control, as well as reduced cooling system length requirements.

Accordingly, there is a need for a method and apparatus for cooling articles which can provide improved efficiency, reduce the size of the cooling system, and a cooling system that does not require external vacuum pumps.

SUMMARY OF THE INVENTION

A method and apparatus for cooling articles are provided which can utilize the dispersion of a liquid cryogen into a feed chamber wherein the liquid cryogen is substantially vaporized and then circulated through a cooling chamber containing the article to be cooled. The vaporized cryogen can be further circulated though the cooling chamber at a controllable velocity, over/around the surface of the article to be cooled and/or tooling, in order to regulate the rate of cooling the article by controlling the wind chill temperature, based upon the principles of forced gas convection.

A presently preferred cryogen is liquid nitrogen. The liquid nitrogen can be dispersed into a feed chamber in a controlled manner using a valve, which can be operated by a controller, such as a microprocessor. Since the temperature in the feed chamber is much higher than the boiling point of the liquid nitrogen, a high BTU (British Thermal Unit) and expansion rate is captured thereby producing an extremely effective refrigerant. The feed chamber can be communicated with a cooling chamber into which the vaporized cryogen can be circulated by a fan, or other device for circulating a gas and/or vaporized cryogen. Either the feed chamber or the cooling chamber can be vented to dissipate pressure generated as the liquid nitrogen rapidly expands to gaseous form. The fan can preferably be a variable speed fan, or other variable speed circulation device, for circulating the vaporized cryogen through the system at a controllable velocity to take advantage of principles of forced gas convection. The fan can be located in the feed chamber to aid in substantially vaporizing the liquid cryogen. However, considering the relatively high temperature utilized in the cooling chamber compared to the boiling point of the cryogen, even without the fan, the liquid cryogen will virtually completely and instantaneously vaporize as it is injected into the feed chamber. The fan can be operated by the controller which can regulate the speed of the fan to provide improved temperature control over the system by controlling the wind chill temperature in the cooling chamber. The system can also include a temperature sensor, connected to the controller, for monitoring the temperature in the cooling chamber, and to calculate the wind chill temperature. An additional external temperature sensor is provided and connected to the controller. The external temperature sensor is adapted to monitor the temperature of an article after the article has exited the cooling chamber and relays the output signal to the controller, which can operate the fan and valve to provide improved temperature control over the system by controlling the wind chill temperature in the cooling chamber in relation to the article's exit temperature. A heating device can be provided to increase the temperature in the cooling chamber, if needed. The speed of the fan can be controlled by the microprocessor to circulate the refrigerant at a high volume (CFM) to maximize the cooling efficiency, thereby minimizing cryogen consumption. Essentially, the rate of cooling of the article can be increased for a given amount of cryogen dispersed into the feed chamber by increasing the speed of the fan. Another way to express this concept is to say that the "effective temperature" in the chamber can be reduced by increasing the speed of the fan. The articles to be cooled can be delivered into the cooling chamber by means of a conveyor belt, or various other ways of feeding articles, for example pulling extrusions, through the cooling chambers.

The cooling system can also employ a plurality of cooling chambers, preferably adjacent, each of which can be individually controlled by one or more controllers. The controllers can manage the speed of the fan and the nitrogen injection for each individual cooling chamber, thereby providing for maximum heat exchange rates for efficiency and effectiveness. Each cooling chamber can be equipped with its own temperature sensor, nitrogen injection valve to control the introduction of nitrogen into the cooling chamber, and variable speed fan for circulating refrigerant through the cooling chamber.

In general operation, the temperature sensor detects the temperature in the cooling chamber, or of the circulated refrigerant, and the external temperature sensor detects the temperature of an article that has exited the cooling chamber and each feed the respective information to the controller. The controller can be programmed with a desired temperature to which the temperature inside the cooling chamber is to be regulated or to the desired temperature of the article as it exits the cooling chamber. The controller can also control the nitrogen injection valve and the speed of the fan to cause the temperature in the cooling chamber to correspond to the desired temperature or temperature calculated to cool the article to the desired article temperature. An equation for calculating the "effective temperature," i.e. wind chill temperature, from the speed of the fan and the ambient temperature in the cooling chamber can be programmed into the microprocessor. The speed of the fan can thus be regulated to increase or decrease the rate of cooling of the article, by adjusting the effective temperature in the cooling chamber, in order to maximize the efficiency of the cooling system. Principles of forced air convection can thus be utilized to increase cooling efficiency while minimizing the consumption of nitrogen. Likewise, principles of forced gas convection can be utilized in combination with principles of "equilibrium" cooling to quickly cool surfaces of an article to produce a "skin" of sufficient rigidity for further handling. A "skin" may be super-cooled (cooled to a temperature below the desired article temperature), but the core remaining at a temperature higher than the desired article temperature. The warmer core regions continue to transfer energy to the cooler "skin" regions after exiting the cooling chamber until the two regions reach an "equilibrium" temperature. Thus, the cooling systems of the present invention can produce the required cooling with less line space. The fan additionally permits improved system control over the effective temperature in the cooling chamber. A method of cooling an article using "equilibrium" cooling according to the invention comprises the following steps: a) introducing liquid cryogen into a feed chamber wherein said liquid cryogen is substantially vaporized; b) circulating said vaporized cryogen from said feed chamber into a separate cooling chamber containing said article to be cooled; c) circulating said vaporized cryogen at a controllable velocity from said feed chamber into said cooling chamber and around said article to create a wind chill temperature in said cooling chamber to increase a rate of cooling of said article; d) sensing the temperature in at least one of said feed chamber and said cooling chamber; e) calculating said wind chill temperature in said cooling chamber, said wind chill temperature being a function of the temperature in said cooling chamber and the velocity at which said vaporized cryogen is circulated through said cooling chamber over said article; f) selecting a desired product temperature; g) sensing the temperature of the article prior to entering said cooling chamber and calculating a difference between said desired product temperature and said temperature of the article prior to entering said cooling chamber; h) calculating an amount of energy that must be removed from said article during the resonance time said article is in said cooling chamber necessary to cool greater than 50% of the mass of said article to a super-cool temperature below the desired product temperature, such that the difference between said super-cool temperature and said desired product temperature is greater than or equal to said difference between the sensed temperature of the article prior to entering the cooling chamber and the desired product temperature, said amount of energy being a function of the heat capacity, thermal conductivity, and resonance time of said article in said cooling chamber; i) calculating a wind chill temperature necessary to remove said amount of energy; and i) controlling said velocity to cause said wind chill temperature to correspond to said wind chill temperature necessary to remove said amount of energy.

Another embodiment of the invention is a cooling system which, utilizing wind chill temperatures, is particularly adapted to vaporize a liquid cryogen and circulate the refrigerant over/pass metal tools for an article within the tool. Specific examples of such tools are a calibrator and a sizing template, which are commonly used to cool extruded articles. The metal tools are provided with a plurality of fins extending from an outer surface thereof that provide for increased external surface area. The metal tools are enclosed within a cooling chamber, or chambers and the metal tools, such as calibrators, through which an extrusion is passed to be cooled, is itself, along with the extrusion, cooled within a cooling chamber. Advantageously, such a system can be vacuum assisted without the need for costly external vacuum pumps. The cooling chamber includes an outlet throat through which refrigerant enters the cooling chamber and an inlet throat through which the refrigerant exits the cooling chamber and is recirculated by a fan. By providing the outlet throat with a cross-sectional area less than the cross-sectional area of the inlet throat, the fan is thus "starved" and a vacuum is induced within the cooling chamber. Preferably, a restrictor plate or other suitable mechanism is provided that can be operated to vary the cross-sectional area of the outlet throat, inlet throat, or both.

Another embodiment of the invention is a cooling system which, utilizing principles of forced gas convection, is particularly adapted to vaporize a liquid cryogen and circulate the vaporized through a hollow within an extrudate. The cooling system includes similar components as previously discussed, except the vaporized cryogen is communicated to the hollow through an inlet bore provided in an extruder die and mandrel. Preferably, the cooling system is "captive" and the vaporized cryogen is recirculated. For example, the vaporized cryogen can exit the hollow within a closed cutting chamber. The cutting chamber communicates with a fan via a return conduit. Operation of the system is the same as previously described. Optionally, the cooling system is used in combination with a cooling system to simultaneously cool the outer surface of the extrudate, such as a metal tool cooling system according to the invention.

Other details, objects, and advantages of the invention will become apparent from the following detailed description and the accompanying drawing figures of certain embodiments thereof.

BRIEF DESCRIPTION OF THE DRAWING FIGURES

A more complete understanding of the invention can be obtained by considering the following detailed description in conjunction with the accompanying drawings, in which.

DETAILED DESCRIPTION OF THE PREFERRED EMBODIMENT

While the present invention will be described fully hereinafter with reference to the accompanying drawings, in which a particular embodiment is shown, it is to be understood at the outset that persons skilled in the art may modify the invention herein described while still achieving the desired result of this invention. Accordingly, the description that follows is to be understood as a broad informative disclosure directed to persons skilled in the appropriate art and not as limitations of the present invention.

Figure 1:
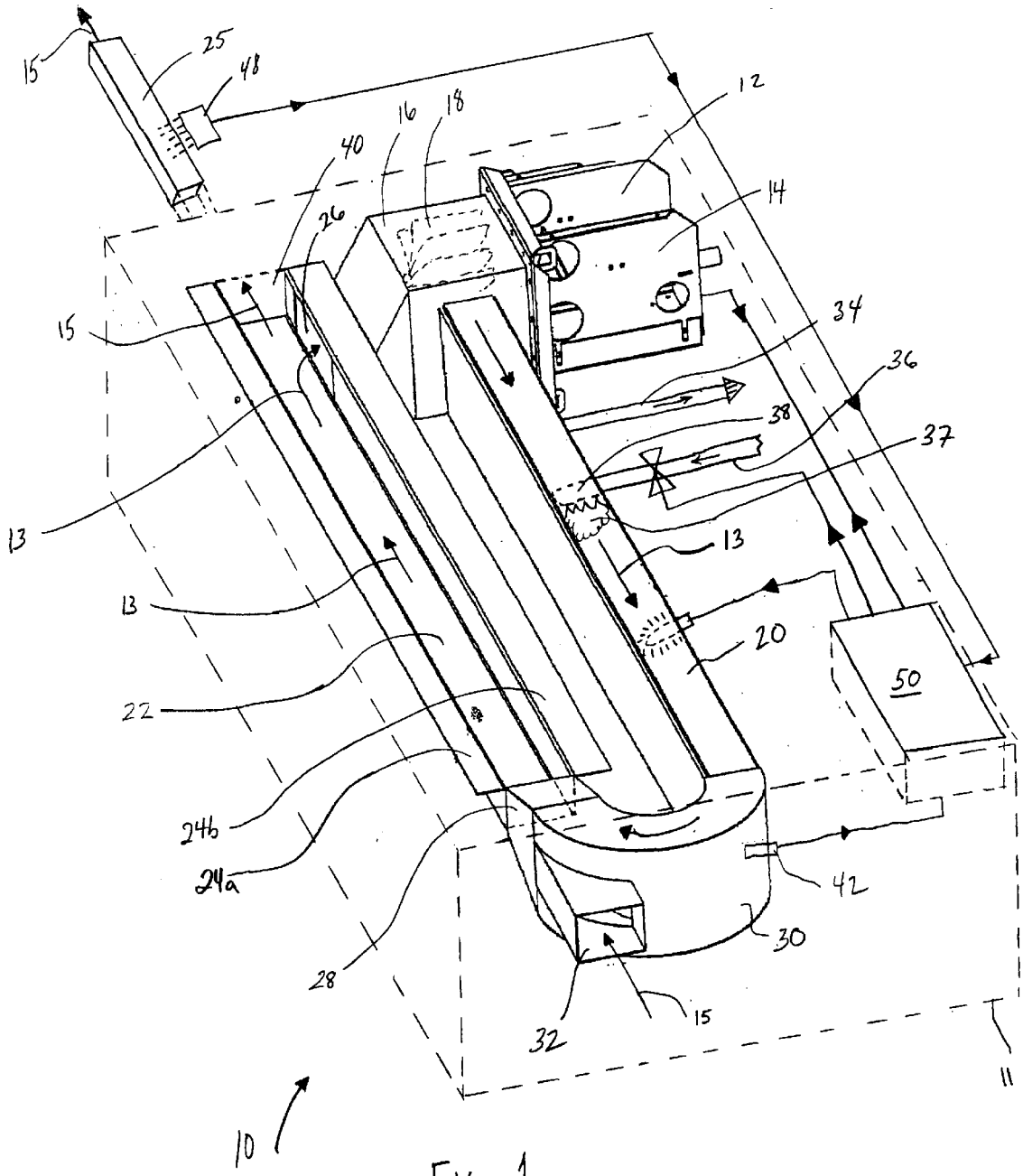
FIG. 1 is perspective view of a simplified representation of a presently preferred embodiment of a forced gas convection cooling system.

A simplified perspective view of a forced gas convection cooling system 10 is shown in FIG. 1, depicting the internal duct work of the cooling system with an external "chamber" 11 shown in phantom lines. The framework and insulation materials have been removed for ease of discussion. Forced gas convection cooling systems are described in U.S. Pat. No. 6,389,828, which is incorporated herein in its entirety. The cooling system 10 includes a variable speed fan 12 or other suitable means for circulating a gas. The fan 12 includes a motor housing 14 and a blade housing 16, which encloses fan blades 18. The cooling system 10 includes a back chamber 20, referred to as a "feed" chamber, and a front chamber 22, known as the "cooling" chamber, connected by end duct 30. The end duct 30 includes an extrudate passage 32, or other opening, through which an extrudate 25 (shown in FIG. 1 after passing through the cooling system for ease of illustration) may enter or exit the cooling system 10, preferably traveling in a direction shown by arrow 15. In operation, the fan 12 preferably circulates the gas contained in the system in a direction shown by arrows 13, although circulation may be in the reverse direction if desired. Gas is drawn into the blade housing 16, which acts as a return chamber, from the front chamber 22 through an inlet throat 26 and discharged from the fan 12 into the back chamber 20. The gas enters the front chamber 22 from the end duct 30 through outlet throat 28, such that the gas travels through the front chamber 22 in the same direction as the extrudate. This process can be repeated as the gas is continuously circulated through the cooling system 10 to cool an extrudate. A liquid cryogen feed line 36 is in communication with a liquid cryogen source (not shown) and is adapted to deliver liquid cryogen, such as nitrogen, to the system 10. Preferably, the feed line 36 extends into the back chamber 20 and includes a spray bar 38 having a plurality of orifices to evenly inject and distribute liquid cryogen. Preferably, the feed line 36 is placed in communication with the back chamber 20 downstream from the fan 12 to inject or distribute liquid cryogen into the stream of circulated gas, which aids in the vaporization and distribution thereof before it reaches the front chamber 22 containing the extrudate. At the presently preferred operating temperatures of the cooling system 10, substantially complete and instantaneous vaporization of the liquid cryogen occurs upon release or injection into the back chamber 20 or any other suitable point of entry. However, there may be alternative applications wherein a much lower operating temperature may be utilized, such that there is a greater probability of the liquid cryogen not totally vaporizing. In such applications, a larger feed chamber (not shown) in combination with the fan 12 can provide a region wherein substantially complete vaporization of the liquid cryogen is provided, thereby reducing the likelihood of any liquid cryogen being distributed onto the surface of the extrudate. The liquid cryogen is preferably liquid nitrogen, however, other cryogens such as liquid carbon dioxide, liquid air and other refrigerants having normal boiling points substantially below minus 50° F. (−46° C.) can also be used. The liquid nitrogen expands 700 times its volume in liquid state, capturing a high BTU as it transitions to gaseous form, creating a highly effective refrigerant and rapidly reducing the temperature in the cooling system 10. The fan 12 can be controlled by a controller 50 to circulate the vaporized cryogen at a variable velocity through the back chamber 20, end duct 30, and front chamber 22 where it cools the extrudate. The cooling process continues, including the injection of additional liquid cryogen into the back chamber 20 as needed to obtain, or maintain, a desired temperature in the front chamber 22. The extrudate enters the cooling system through the extrudate passage 32 and travels through the front chamber 22 where it is cooled by the circulating cryogen gas. An extrudate outlet passage 40, or other opening, is provided at an end of the front chamber 22 opposite the extrudate passage 32 that allows the extrudate to exit the system 10. Preferably, both the extrudate inlet passage and outlet passage 32 and 40 are equipped with a sealing means, such as an end template (shown in FIG. 3), neoprene gasket or other means known in the art, that prevents or reduces the ingress of air and egress of vaporized cryogen to and from the system. Optionally, the sealing means can be selected or designed to permit excess pressure in the system to vent outside. In such a case, a separate vent may not be needed.

The cooling system 10 can further include a number of other components for controlling, optimizing, and generally automating the cooling process. These other components can include a vent 34, an internal temperature sensor 42, and a heating unit 44. The controller 50 can include a microprocessor, for controlling the operation of the cooling system 10, either automatically or under the control of an operator. The vent 34 can be provided, for example in the back chamber 20 as shown, to release pressure build up which may be created by the expansion of the liquid nitrogen as it is injected into the cooling system 10. The vent can simply be a small orifice and is preferably placed upstream of the cryogen feed line 36 and spray bar 38 and downstream of the front chamber 22 (with respect to gas flow as shown by arrows 13) to minimize the loss of cooling capacity. By venting after the gas has been circulated over the hot extrudate and before the spray bar 38 distributes fresh liquid cryogen, the vented gas has removed energy from the product and is the warmest portion of gas in the system and therefore does not waste newly delivered liquid cryogen. The temperature sensor 42 can be provided in communication with the gas stream generally at any point, but is preferably in the front chamber 20, back chamber 22, or end duct 30, as shown, to monitor temperature of the vaporized cryogen at a desired point. Alternatively, the temperature sensor could be positioned elsewhere, such as the blade housing 16 in order to detect the temperature of the gas stream coming into the fan 12. Similarly, additional temperature sensors could be positioned at different locations to detect the temperature of the gas at several points in the cooling system 10. Output from the temperature sensor 42, and other sensors, if more are used, can be provided to the controller 50 for use in regulating the speed of the fan 12 and controlling a valve 46 provided in the cryogen feed line 36 to inject liquid cryogen into the back chamber 20. The temperature sensor 42 can be, for example, a thermocouple. The controller 50 can be programmed with the wind chill equation and can also receive a signal from the fan 12 indicative of the fan's speed. This data can be used to determine the effective temperature in the front chamber 22. The heating unit 44, can be a simple heating element and can be located, for example, in the back chamber 20, as shown in the figure. The heating element can be operated by the controller to increase the temperature in the cooling system 10, if necessary, to adjust and maintain the desired ambient temperature. Multiple such cooling systems may be placed in series and operated independently or together.

In a preferred embodiment of the present invention, an external temperature sensor 48, such as an infrared temperature sensor, is provided at a desired point downstream from the extrudate outlet passage 40 to sense the temperature of the extrudate 25 after exiting the front chamber 22. For example, the external temperature sensor 48 could be placed adjacent the extrudate outlet passage 40 or may be placed further downstream, such as adjacent a cutting assembly or puller. The external temperature sensor 48 senses the surface temperature of the extrudate 25 and relays the output to the controller 50. The controller 50 utilizes the output from external temperature sensor 48 in addition to temperature sensor 42 (and additional temperatures if provided) in regulating the speed of the fan 12 and controlling the valve 46 provided in the cryogen feed line 36 to inject liquid cryogen into the back chamber 20.

The controller 50 can control the speed of the fan 12, the valve 46 to inject the cryogen 37 into the back chamber 20 and the heating unit 44, and thereby closely regulate the wind chill temperature in the front chamber 22 to correspond to, and be maintained at a desired wind chill temperature to ensure that the extrudate exiting the front chamber 22 has reached an optimum product temperature. The optimum product temperature desired for the extrudate exiting the extrudate outlet passage 40 (or other point depending on where the external temperature sensor 48 is placed) can be input to the controller 50 by an operator. The controller 50 can monitor the speed of the fan 12 (and thus the velocity of the gas stream circulating through the front chamber 22) and feedback from the external temperature sensor 48 and temperature sensor 42 to cause the sensed temperature, or calculated wind chill temperature, to increase or decrease depending on the external temperature sensor 48 reading. Thus, the controller can efficiently control the cooling of the extrudate 25 to provide an optimum product temperature (rigidity) for further processing, such as cutting the extrudate 25.

The cooling efficiency of the system can generally be optimized by using principles of forced air convection. Extraction of heat from an extrudate 25 can be increased by blowing cooler air over a warm surface. The "effective" temperature inside the front chamber 22, or "cooling" chamber can be calculated from the ambient temperature and the velocity that the gas (cryogen 37) is blown over the surface of the article 16 using the following equation for calculating "wind chill" temperature:

$$T_{wc}=0.0817(3.71V^{0.5}+5.81-0.25V)(T-91.4)+91.4$$

More specifically, the efficiency of the cooling system 10 can be optimized, i.e., maximum cooling using a minimum amount of liquid cryogen 37, by controlling the speed of the fan 12. In particular, for a given amount of liquid cryogen 37 injected into the back chamber 20 or "feed" chamber, the speed of the fan 12 can be increased in order to increase the rate in cooling of the front chamber 22 without adding more liquid cryogen 37. Only when the speed of the fan 12 is at its maximum, would it be necessary to inject additional liquid cryogen 37 into the back chamber 20 to further reduce the temperature in the front chamber 22. Moreover, the temperature in the front chamber 22 can also be regulated to a set point temperature by adjusting the speed of the fan 12, faster or slower, instead of injecting more liquid cryogen 37. Output from the external temperature sensor allows the controller 50 to manipulate the "wind chill" within the front chamber 22 to increase or decrease the cooling of the extrudate 25. In this sense, the cooling system 10 can be optimized based on the optimum product temperature. Thus, minimum necessary cooling using a minimum amount of liquid cryogen 37 is achieved. In contrast, prior art cryogenic cooling systems typically control the temperature solely by controlling the amount of liquid cryogen injected into the system or only monitor the "wind chill." The efficiency of the system can be further optimized if it becomes necessary to increase the temperature in the cooling chamber by using the heating unit 44. Prior to expending energy to operate the heating unit, the speed of the fan 12 can be reduced to lower the wind chill temperature, and thus decrease the rate of cooling. If reducing the speed of the fan 12 alone is insufficient, then the heating unit 44 can be operated. By reducing the speed of the fan 12 first, energy can be conserved, thus increasing the efficiency of the cooling system 10. It should therefore be appreciated that "rate of cooling," is dependent both on the sensed temperature and the wind chill, i.e., "effective," temperature. To summarize, increasing the speed of the fan 12 results in lowering the effective temperature in the front chamber 22, which results in an increase in the rate of cooling of the extrudate 25. Conversely, reducing the speed of the fan 12 results in an increase in the effective temperature in the front chamber 22, which results in a decrease in the rate of cooling of the extrudate 25. Accordingly, it can be appreciated that controlling the speed of the fan 12 and cryogen injection in relation to the extrudate temperature after exiting the "cooling" chamber 22 can be advantageously utilized to control the "effective" temperature in the "cooling" chamber 22, and thus the rate of cooling of the extrudate 25. This prevents ineffective or unnecessary "overcooling" of the extrudate, when only the optimum product temperature must be reached.

It also should be understood that the configuration and number of passageways provided to circulate the gas through the cryogenic cooling system, and around the article to be cooled, can be varied to suit different applications and conditions. Consequently, the embodiments illustrated are by way of example only, and are in no way intended to be an exhaustive representation of every possible configuration.

Figure 2:
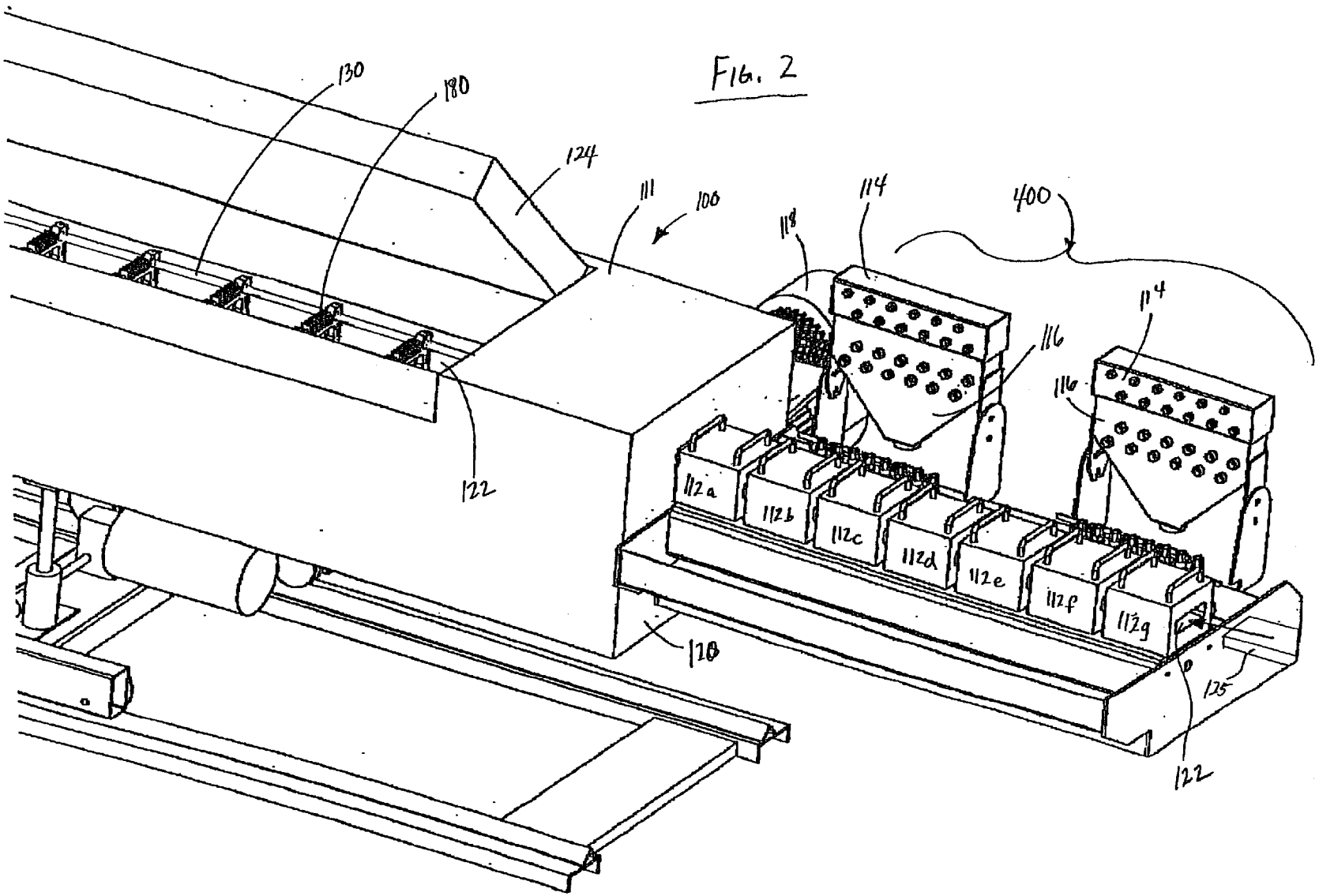
FIG. 2 is a perspective view of another presently preferred embodiment of a forced gas convection cooling system 100 in combination with a conventional wet jacketed vacuum calibration cooling system 400.

Instead of or in addition to cooling the outer surface of an article, vaporized cryogen can also be used to cool tooling, or articles held therein, by circulating cooling water or vaporized cryogen (as disclosed in U.S. Pat. No. 6,389,828) through internal cooling passageways, e.g., cooling circuits, provided in the tooling. One example applicable to cooling extrusions is tools called calibrators. A prior art type calibrator based cooling system 400, often referred to as a wet, vacuum-jacketed calibration tooling is shown in FIG. 2 in combination with a downstream cooling system 100 configured similarly to the cooling system 10 shown in FIG. 1 and including a sizing template assembly 180 positioned in front chamber 122, discussed in more detail below. Cooling system 100 is shown with an external chamber 111 having a top cover 124 in an open position that surrounds the front chamber 122, back chamber (not shown), end duct (not shown), etc. that is depicted in FIG. 1 with respect to cooling system 10. A fan 118 is shown positioned near a front end 120 of cooling system 100, however, the cooling system fan is preferably positioned near the rear end (not shown) as detailed in cooling system 10 illustrated in FIG. 1. The cooling system 400 includes a calibrator 112, and such a system can typically utilize several, such as calibrators 112*a–g,* positioned at spaced apart locations through which an extrudate 125 is fed and thereby cooled. Water and vacuum conduits (not shown) are connected to a water manifold 114 and vacuum manifold 116 respectively, such that cooling water (or vaporized cryogen) may be circulated through the internal cooling circuits and a vacuum may be applied to the outer surface of the extrudate 125 to assist in maintaining its shape. The extrudate enters system 400 through a calibrator inlet passage 122, seen in calibrator 112*g*. A vacuum is drawn through grooves in the calibrator 112 to maintain contact between the extrudate 125 and an inner face of the calibrator extrudate passage. However, these prior art calibrator-based cooling systems require costly external vacuum pumps to create an assist vacuum and often also come with the disadvantages of using cooling water. The present invention eliminates the need for the external vacuum pumps and the associated vacuum/water conduits associated with the prior art systems.

Figure 3:
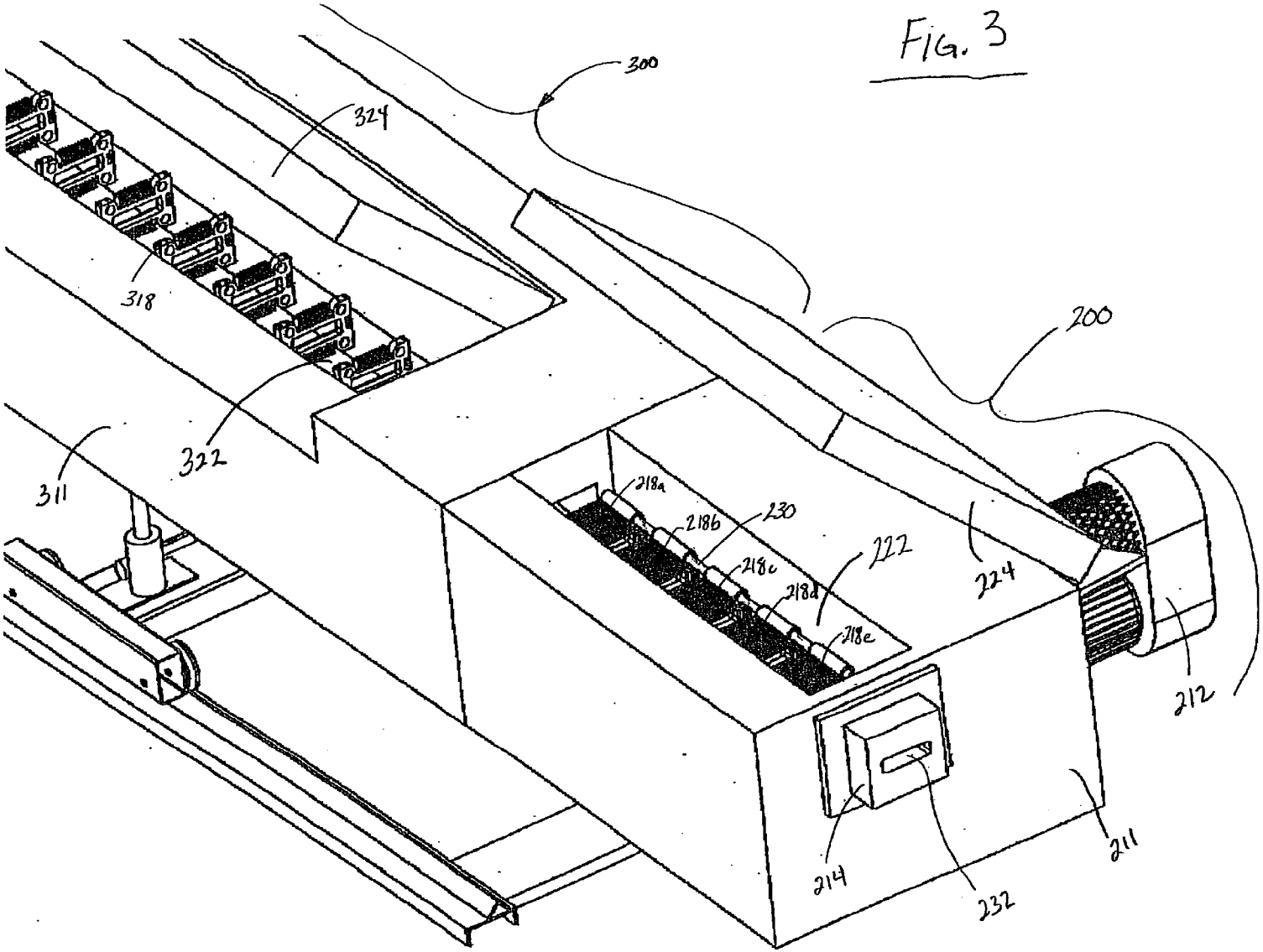
FIG. 3 is a perspective view of an embodiment of a forced gas convection cooling system 300 using sizing templates in combination with a forced gas convection calibration cooling system 200.

Referring to FIG. 3, a forced gas convection calibration tooling cooling system 200 is shown in combination with a downstream forced gas convection sizing template cooling system 300. Cooling system 200 includes a fan 212 and external chamber 211 and top cover 224 that surrounds the remaining elements discussed in reference to cooling system 10 and shown in FIG. 1, including a front chamber 222. Similarly, cooling system 300 includes a fan (not shown) and external chamber 311 and top cover 324 that surrounds the remaining elements discussed in reference to cooling system 10 and shown in FIG. 1, including a front chamber 322. An end template 214 is provided on external chamber 211 that includes an extrudate inlet passage 232 and provides a means of sealing against the extrudate (not shown) as previously discussed. Optionally, fan 212 may be used to circulate vaporized cryogen through both cooling system 200 and 300, however, it is preferred that each cooling system 200 and 300 have an independent fan such that the systems may be controlled separately or separated altogether for different operations. A calibrator assembly 216 is positioned within front chamber 222. The calibrator assembly 216 includes individual calibrators 218*a–e* coupled to guide rail 230. The number of calibrators used in a calibrator assembly can vary from one to any number, and depending on the requirements of the product. Likewise, the size and shape of the calibrator(s) may vary depending on the specific product to be produced. The vaporized cryogen is circulated thorough front chamber 222 over the extrudate outer surface and the calibrators 218*a–e.*

Figure 4:
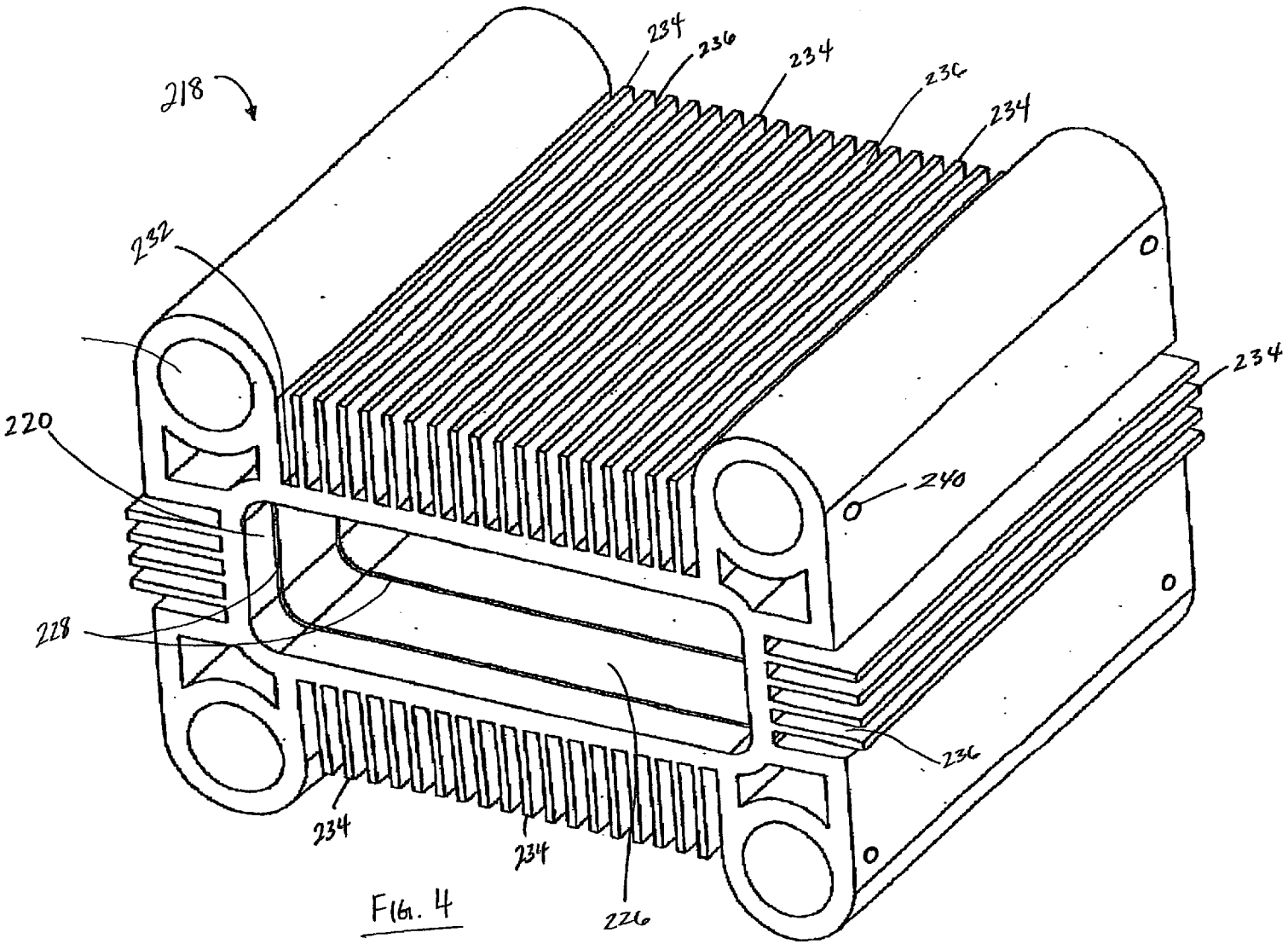
FIG. 4 is a perspective view of a calibrator according to the invention.

A calibrator 218 for use with cooling system is illustrated in FIG. 4. The calibrator 218 includes a product passage 220 defining an inner surface 226 that makes contact with, but also provides for the passage of an extrudate. By making contact with the extrudate, the calibrator 218 acts as a heat sink and removes energy from the extrudate through conduction. The calibrator 218 also assists the extrudate in maintaining its extruded shape. The calibrator has an outer surface 232 including a plurality of fins 234 extending outwardly therefrom and running substantially parallel to the center axis of the product passage 220. The plurality of fins 234 define a plurality of channels 236 there between. Inclusion of the plurality of fins 234 greatly increases the outer surface area of the calibrator 218. By increasing the outer surface area of the calibrator 218, greater amounts of energy can be dissipated to the vaporized cryogen circulated in the cooling system 200. The vaporized cryogen flows over the outer surface of the calibrator removes energy therefrom by forced gas convection. The greater the outer surface area of the calibrator means greater contact with the circulated cryogen and more heat transfer. The plurality of fins 234 also increase the mass of the calibrator 218 which increases the amount of energy (heat) the calibrator can remove from the extrudate. Preferably, vacuum grooves 228 are provided in the inner surface 226, preferably spaced apart and extending the entire circumference of the product passage 220. At least one pinhole (not shown) is provided from within each vacuum groove 228 and extending to the outer surface, such that the pressure realized outside of the calibrator 218 is also communicated to the vacuum groove 228. Preferably, a pinhole is provided at the bottom of each channel 236 such that a single vacuum groove includes a plurality of pinholes in communication with the atmosphere outside the calibrator 218. Therefore, production of a vacuum within the front chamber 222 is transferred to the vacuum grooves 228. A vacuum within the vacuum grooves 228 assists in maintaining the extrudate in contact with the calibrator, which in turns ensures a proper shape and advantageous conductive heat transfer. Preferably, the calibrator includes at least one guide slot 238 adapted to provide passage of a guide rail 230 (see FIG. 3) such that the calibrator 218 may be secured in a cooling system. A setscrew 240 allows the calibrator 218 to be tightly secured to the guide rail 230.

Figure 5:
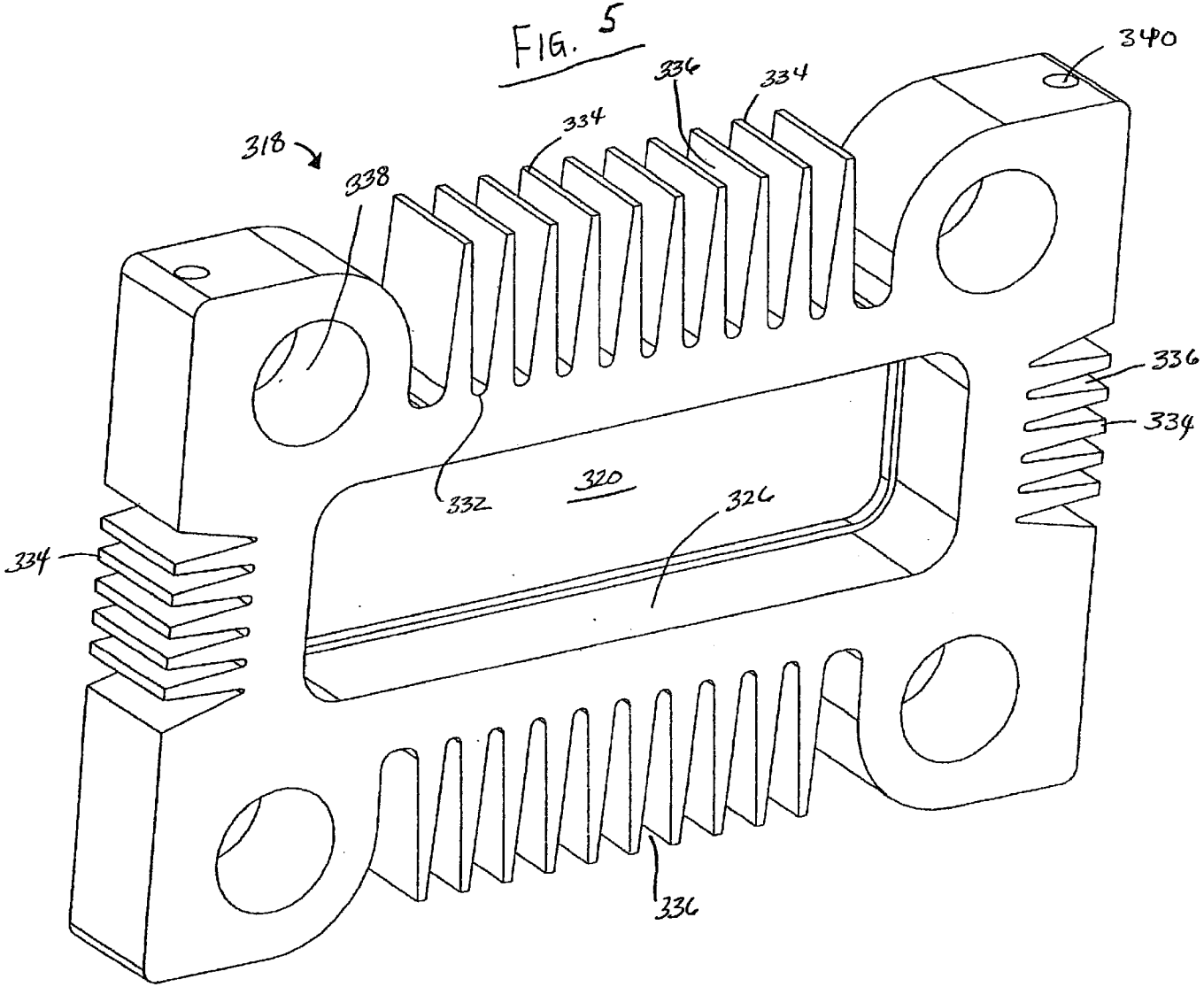
FIG. 5 is a perspective view of a sizing template according to the invention.

FIG. 5 illustrates a sizing template 318, another type of tooling that may be used with the present invention, that is similar to the calibrator 218 shown in FIG. 4. The sizing template 318 includes a product passage 320 defining an inner surface 326 that makes contact with, but also provides for the passage of an extrudate. The sizing template 318 has an outer surface 332 including a plurality of fins 334 extending outwardly therefrom and running substantially parallel to the center axis of the product passage 320. The plurality of fins 334 define a plurality of channels 336 there between. As previously discussed, inclusion of the plurality of fins 334 greatly increases the outer surface area of the sizing template 318. Optionally, a circumferential rib 328 is provided in the inner surface 326. Several such ribs may be incorporated, preferably spaced apart and extending the entire circumference of the product passage 320. Preferably, the sizing template 318 includes at least one guide slot 338 adapted to provide passage of a guide rail 130 (see FIG. 2) such that the sizing template 318 may be secured in a cooling system (see FIG. 2). A setscrew 340 allows the sizing template 318 to be tightly secured to the guide rail 130.

Figure 6:
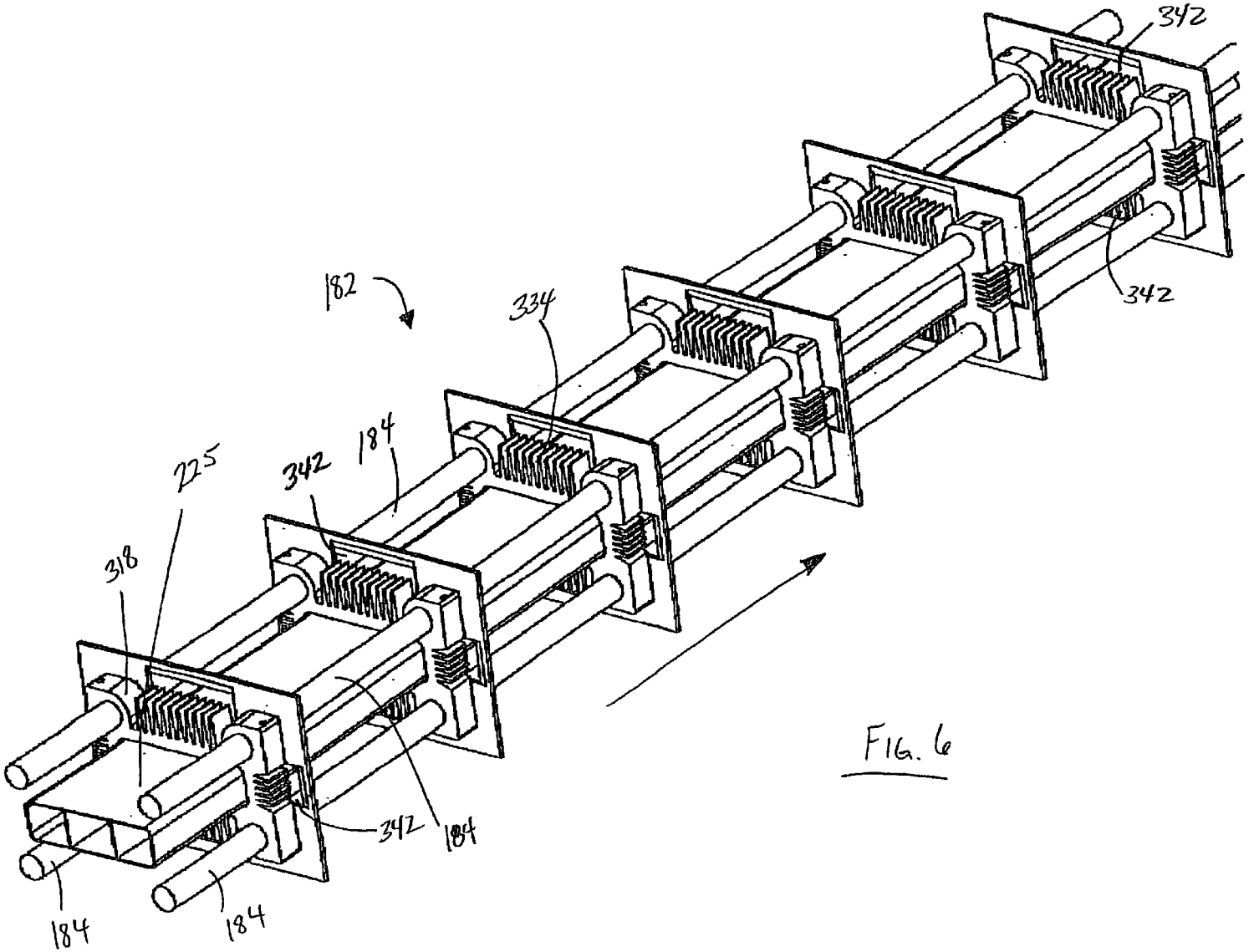
FIG. 6 is a front perspective view of a sizing template assembly.
Figure 7:
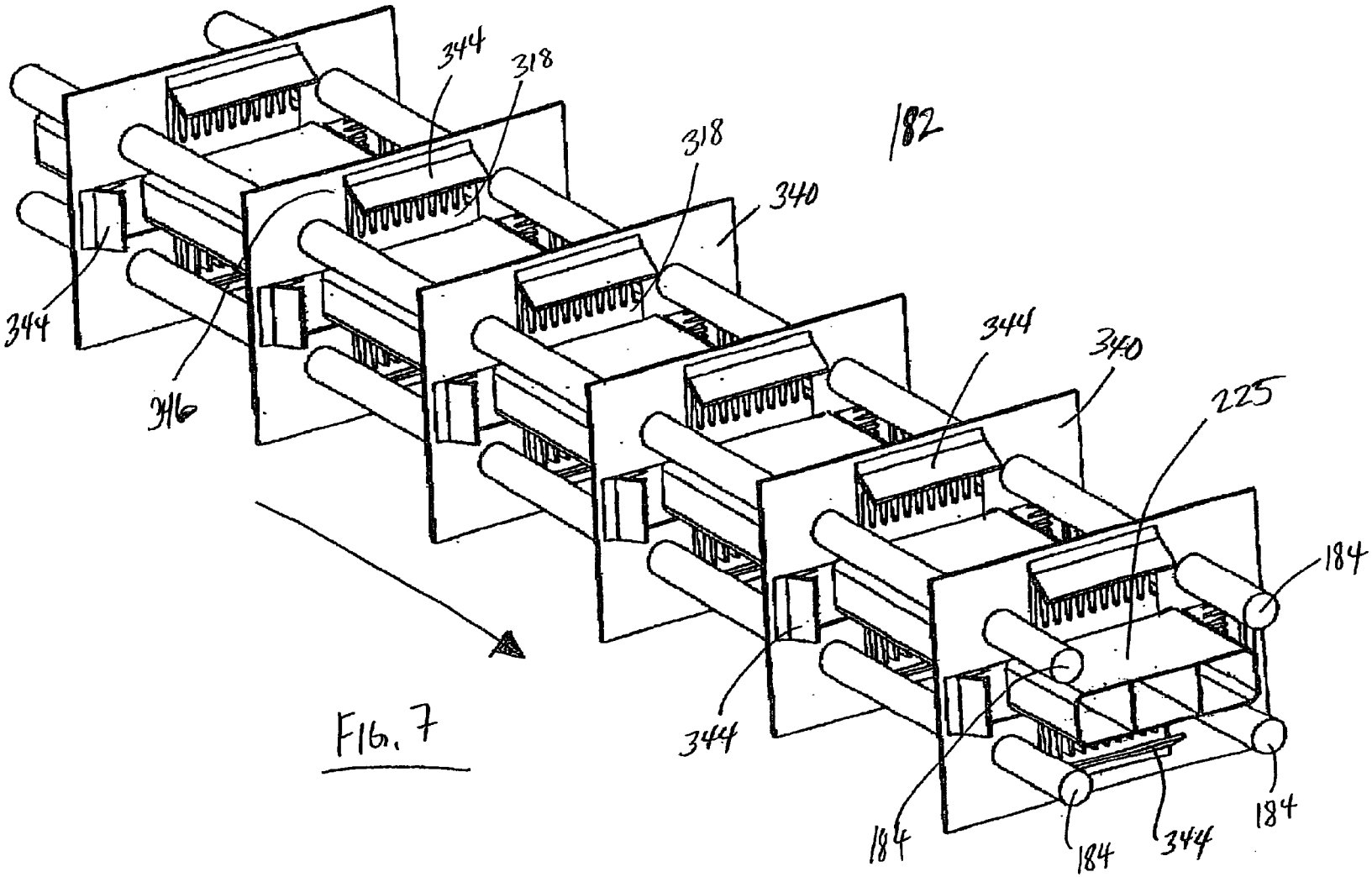
FIG. 7 is a front perspective view of the sizing template assembly shown in FIG. 6.

FIGS. 6 and 7 depict a front perspective and rear perspective, respectively, of a sizing template assembly 182 including an extrudate 225 passing through the product passages in the direction of arrow 186. Although, the foregoing description is made with respect to a sizing template assembly, a calibrator assembly for use with the present invention may be structure in the same general way. The assembly 182 includes a plurality of sizing templates 318 positioned on four guide rails 184. Preferably each sizing template 318 is positioned adjacent to a complimentary deflector plate 340. As best seen in FIG. 6, each deflector plate 340 includes gas flow passages 342 that are adapted to guide the flow of vaporized cryogen over/through the plurality of fins 334 extending from the outer surface of the sizing template 318. The deflector plate preferably includes a spoiler 344 (FIG. 7) extending from a backside 346 of the deflector plate in a generally downward direction. The spoilers 344 operate to direct the gas flow along the outer surface of the extrudate 225. The assembly 182 is adapted to be placed within the front or "cooling" chamber of a forced gas convection cooling system.

Figure 8:
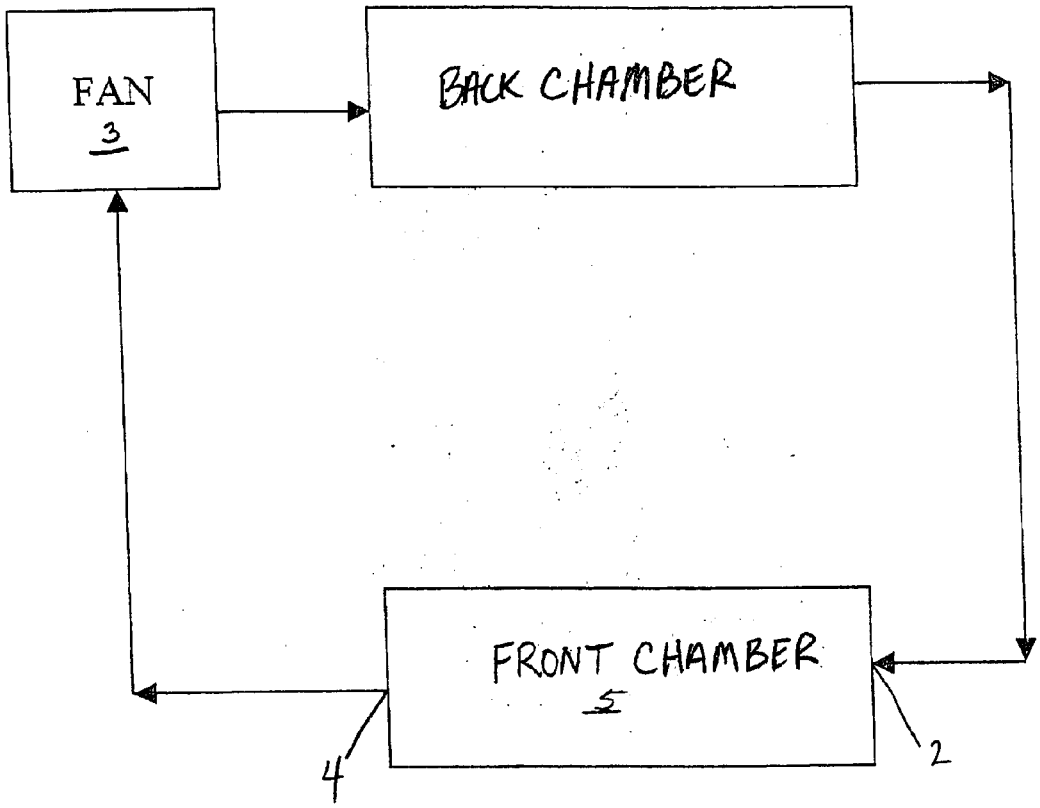
FIG. 8 is schematic representation of the method of inducing an internal vacuum.

The forced gas convection calibration cooling system 200 and other forced gas convection cooling systems according to the invention do not require separate external vacuum pumps to provide vacuum assistance to the calibrators and other tools. Advantageously, the cooling system 200 may be operated to internally induce a vacuum within the front chamber 222 or "cooling"/calibration chamber. Referring back to FIG. 1 and cooling system 10, which illustrates the internal duct-work and system components included in the forced gas convection cooling systems according to the present invention, gas flow enters the front chamber 22 from the end duct 30 via outlet throat 28 and exits the front chamber 22 to the blade housing 16 of fan 12 via inlet throat 26. A vacuum is generated in the front chamber by operating the fan 12 and restricting the flow of gas into the front chamber 22. Preferably, this is accomplished by ensuring that the cross-sectional area of the outlet throat 28 is less than the cross-sectional area of the inlet throat 26. In this manner, the fan 12 is "starved" and produces a vacuum in the front chamber. The vacuum produced in the front chamber can easily reach 15 inches of water, but varies depending on the strength of the fan 12. Such an internally induced vacuum can be produced with any forced gas convection system having a substantially "captive" system meaning that the gas circulation is a closed loop. Preferably, the outlet throat 28 is of a similar cross-sectional area as the inlet throat 26 but is affixed with a restrictor plate (not shown) which can be mechanically operated (manually or by a solenoid actuator driven by the controller 50) to vary the cross-sectional area of the outlet throat 28. Thus, the controller 50 can manipulate and control the pressure within the front chamber 22. A pressure sensor may be provided to sense the pressure within the front chamber 22 and send feedback to the controller 50 which then adjusts the cross-sectional area of the outlet throat 28 and hence the pressure. In a reverse scenario, if a positive pressure is required within the front chamber 22, then the cross-sectional area of the outlet throat 28 should be larger than the cross0sectional area of the inlet throat 26. In this instance, the inlet throat 26 can also be provided with a similar restrictor plate and control or simply designing the outlet throat 28 and restrictor plate such that a cross-sectional area of the outlet throat 28 can vary from an area less than to an area greater than the cross-sectional area of the inlet passage 26. Referring to FIGS. 1–3, operation of the cooling systems 10, 100, 200 and 300 accordingly can provide a reduced pressure or "vacuum" within front chambers 22, 122, 222 and 322 respectively. FIG. 8 depicts a schematic representation of the method of creating an internally induced vacuum within the "cooling" chamber of a forced gas convection cooling system. Operation of the fan 3 and maintaining a cross-sectional area of inlet 2 into front chamber 5 less than the cross-sectional area of outlet 4 produces a vacuum in the front chamber 5.

Figure 10:
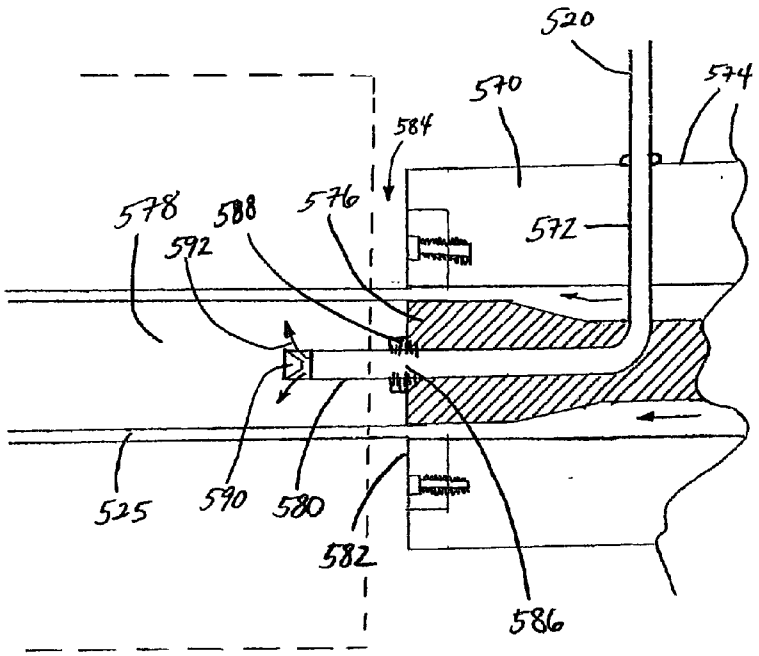
FIG. 10 is a section view taken along line 571—571 of FIG. 9.
Figure 9:
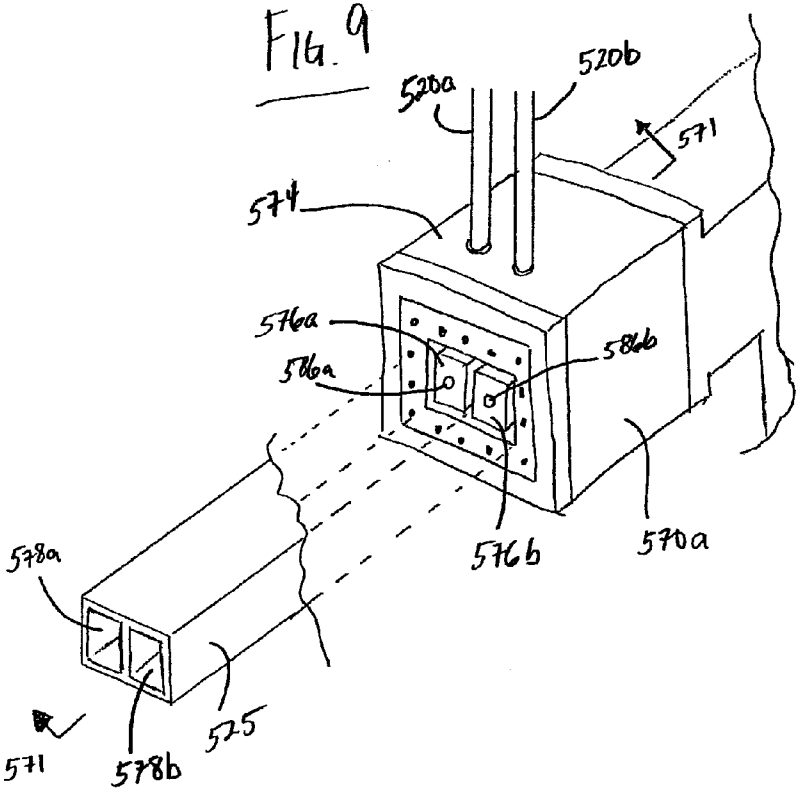
FIG. 9 is a perspective view of an extruder die having two mandrels to form an extrudate with two hollows.
Figure 11:
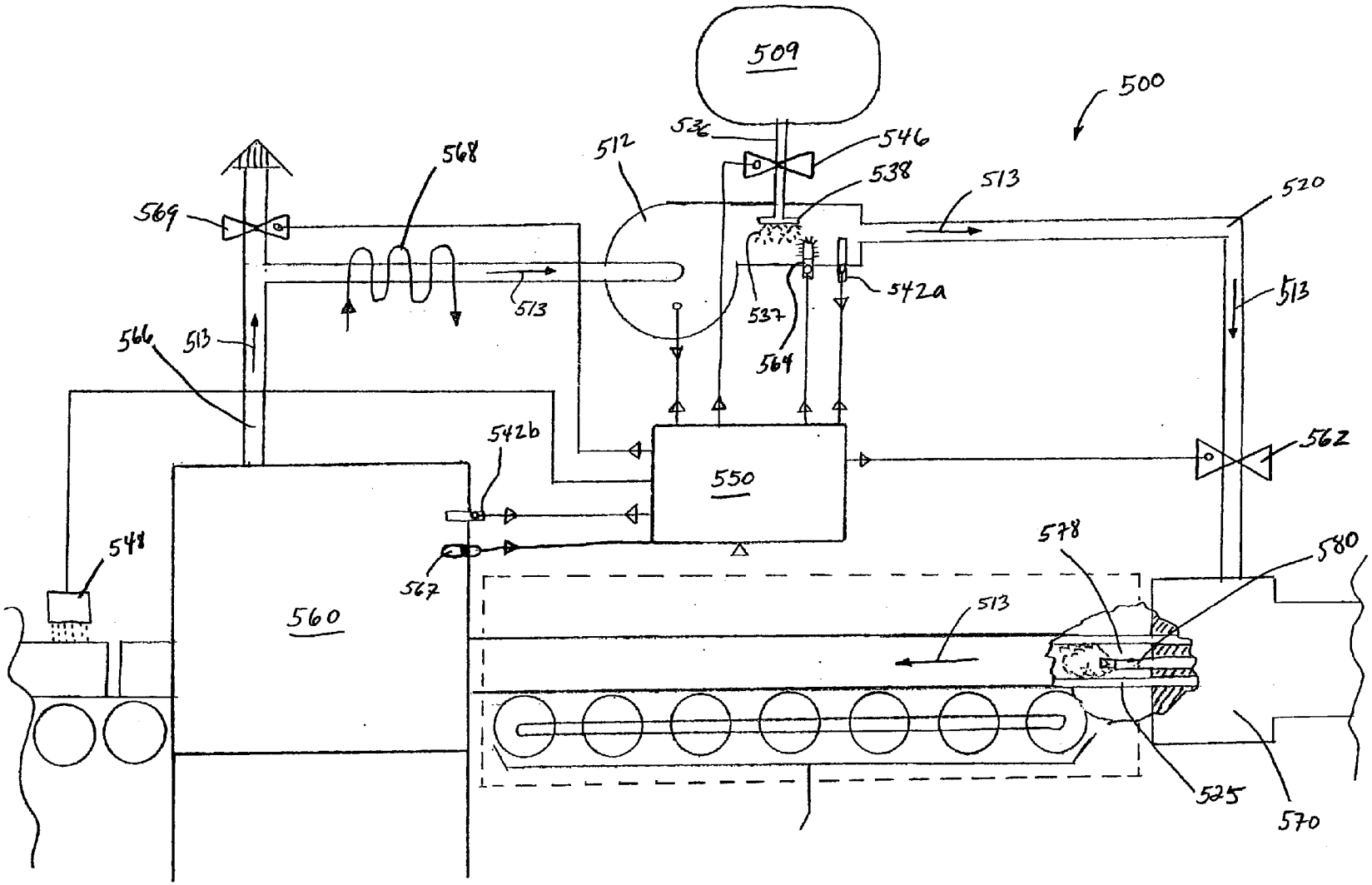
FIG. 11 is a side view of a schematic representation of a presently preferred embodiment of a forced gas convection system for internally cooling an extrudate having a hollow.

Another preferred embodiment of the present invention is illustrated by FIGS. 9–11. FIG. 11 shows a simplified version of a forced gas convection cooling system 500 for internally cooling an extrusion having a hollow profile. The components and operation of the cooling system 500 are generally the same as for the cooling systems 10, 200 and 300 illustrated in FIGS. 1–3, except that an outlet conduit 520 and the extrudate 525 essentially replace the front and back chambers. In particular, a source 509 of liquid cryogen 537, preferably liquid nitrogen, the injection of which into the cooling system through spray bar 538 can be controlled by a feed valve 546 placed in feed line 536, which itself can be operated by a controller 550. As previously discussed, the liquid cryogen 537 substantially instantaneously vaporizes and cools the gas stream circulated by the fan 512, preferably in a direction shown by arrows 513. The vaporized cryogen stream is communicated to an extruder die 570 via outlet conduit 520. Extruder die 570 is shown in more detail in FIGS. 9 and 10. Extruder die 570 includes an inlet bore 572 extending from an outer surface 574 of the extruder die 570 through a mandrel 576 that is adapted to form an extrudate hollow 578 within the extrudate 525. The inlet bore 572 is adapted to be placed in fluid communication with the outlet conduit 520 and thereby pass vaporized cryogen through the extruder die 570 and mandrel 576 and into the extrudate hollow 578. Preferably, the inlet bore 572 and outlet conduit are separably coupled such that different dies can be interchanged for different product configurations. Inlet bore 572 terminates at a mandrel outlet 586 where vaporized cryogen may enter the extrudate hollow 578. Optionally, an outlet extension 580 is provided to ensure that the pressure exerted by the vaporized cryogen as it is introduced into the extrudate hollow 578 is spaced from a leading edge 582 of the die 570. Optionally, the cooling system 500 is used in combination with an external forced gas convection cooling system, such as described in systems 10, 100, 200 and 300 (shown in phantom in FIGS. 10 and 11), that are placed substantially adjacent the die 570, but a small separation 584 may exist. If the outlet extension 580 is not used, then a positive pressure within the extrudate hollow 578 may cause a bubble or distortion within the small separation that is undesirable. Preferably, a forced gas convection calibration cooling system, such as cooling system 200, is used immediately adjacent the extruder and in combination with cooling system 500. In this scenario, the outlet extension is selected to have a length such that the vaporized cryogen is released at a point within the length of a calibrator and the distortion problem is thus minimized. Preferably, mandrel outlet 586 and outlet extension 580 are separably coupled, such as with threads 588, so that different length extensions may be used. The outlet extension 580 includes a nozzle 590 or other means for directing the flow of vaporized cryogen onto an inner surface of the extrudate 525, as shown by arrows 592.

FIG. 9 depicts a die 570*a* configuration including two mandrels 576*a* and 576*b* that form extrudate hollows 578*a* and 578*b*, but do not include outlet extensions. An outlet conduit manifold (not shown) can be provided to provide more than one vaporized cryogen streams to two separate outlet conduits 520*a* and 520*b* and inlet bores, or an inlet bore manifold (not shown) may be provided to split a single vaporized cryogen stream into any number of inlet bores to provide vaporized cryogen to extrudate hollows. Splitting a single stream ensures that the temperature of the vaporized cryogen streams entering different hollows is substantially the same. However, depending on the profile of an extrudate, it may be desirable to provide each hollow with streams of a different temperature. In this case, each hollow that requires a separate temperature is placed in communication with a separate forced gas convection cooling system as herein disclosed.

Referring again to FIG. 11, temperature sensors 542*a* and 542*b* can be provided for detecting the ambient temperature in the outlet conduit 520, preferably at a point downstream from liquid cryogen spray bar 538, or within cutting chamber 560 and outputting that information to the controller 550. Additionally, an external temperature sensor 548, such as an infrared sensor, can be provided that outputs a product temperature reading to the controller 550 as discussed with respect to cooling system 10 illustrated in FIG. 1. An outlet conduit valve 562 can similarly be operated by the controller 550. A heating unit 564 can be provided that is operable by the controller to input heat to the system if necessary. A conveyor system 558 can similarly be used to support the extrudate 525 between the extruder and any downstream equipment. The controller 550 can regulate the temperature in the outlet conduit by controlling the fan 512 and the feed valve 546 based upon feedback from the temperature sensor 542*a,* the temperature sensor 542*b,* the external temperature sensor 548 or all three sensors. The controller 550 is programmed to operate system 500 in a similar manner as disclosed for system 10 to optimize the system's efficiency using principles of forced gas convection. The controller can regulate the speed of the fan 512, operate feed valve 546 to control release of liquid cryogen 537 into outlet conduit 520 and the heating unit 564 to closely regulate the "wind chill" temperature within the extrudate hollow 578 to correspond to, and be maintained at the desired wind chill temperature which can be input by an operator. Optionally, the controller 550 can also act as the controller for additional cooling systems, such as systems 10, 100, 200 and 300 discussed herein, used in combination with cooling system 500.

Preferably, the cooling system 500 is captive, i.e., closed, such that substantially no outside air enters the vaporized cryogen and the vaporized cryogen is recirculated. The extrudate 525 enters the closed cutting chamber 560 through an inlet portion (not shown) and exits through a similar outlet portion (not shown) provided with appropriate sealing portions as known to those in the art. Cutting chamber 560 includes a means for severing the extrudate 525 into desired lengths for further processing or as the final product. The extrudate 525 enters the cutting chamber 560 through a cutting chamber inlet (not shown) provided with appropriate sealing portions as known to those in the art. A saw (not shown) or other suitable cutting means is housed in the cutting chamber 560 and is operated to periodically cut the extrudate 525 into predetermined lengths. Care should be taken such that during the cutting stroke, the vaporized cryogen is allowed to escape from within the extrudate hollow 578, such as through a saw blade (not shown) provided with slots. The slots prevent a positive cryogen pressure build-up within the extrudate 525 during the cutting stroke. If a continuous blade is used, even the brief amount of time required for the cutting stroke may cause a blockage of the flow of cryogen through the extrudate hollow 578, and thus cause bellowing and distortion of the product as well as increased drag on tooling equipment. Return conduit 566 channels the vaporized cryogen back to the variable speed fan 512. A vent 568 and vent valve 569 are provided to allow pressure in the system to be controlled by the controller 550. Pressure sensor 567 can give feedback to the controller 550 which then operates the vent valve 569, fan 512, feed valve 546, and outlet conduit valve 562 to vary the pressure within the system. Additional pressure sensors may be included at other points within the system to give feedback to the controller 550. Optionally, a heat exchanger 568, e.g., a shell and tube exchanger, is provided to pre-cool the recirculated cryogen and thus reduce the consumption of liquid cryogen 537. A heating element 50 may be provided in communication with the circulated cryogen 24, such as in the return conduit 42 as shown, such that heat may be added to the system if necessary.

Advantageously, the present invention allows an extrudate with a hollow profile to be cooled from the outside and from within. The internal and external surfaces of the extrusion can be cooled at equal or variable rates, which allows for extensive process control heretofore unseen. The present invention, by providing cooling from within the extrusion, provides for quicker cooling and shorter cooling chamber lengths. Also, the internal gas flow of cryogen provides a positive pressure against the internal surfaces of the extrusion, which in turn reduces or eliminates the need for an external vacuum on the outer surface of the extrudate to provide a quality product. Since less external vacuum is required, the amount of drag between the product and tooling is reduced, which provides for increased rates of production and smaller downstream, equipment such as pullers.

Various features of the invention have been particularly shown and described in connection with the illustrated embodiments of the invention, however, it must be understood that these particular embodiments merely illustrate and that the invention is to be given its fullest interpretation within the terms of the appended claims.

What is claimed is:

1. A method of cooling an article comprising:

a) introducing liquid cryogen into a feed chamber wherein said liquid cryogen is substantially vaporized;

b) circulating said vaporized cryogen from said feed chamber into a separate cooling chamber containing said article to be cooled;

c) circulating said vaporized cryogen at a controllable velocity from said feed chamber into said cooling chamber and around said article to create a wind chill temperature in said cooling chamber to increase a rate of cooling of said article;

d) sensing an internal chamber temperature in at least one of said feed chamber and said cooling chamber and relaying said internal temperature to a controller;

e) sensing an external temperature of said article after said article has exited said cooling chamber and relaying said external temperature to said controller;

f) calculating said wind chill temperature in said cooling chamber, said wind chill temperature being a function of the internal temperature in said cooling chamber and the velocity at which said vaporized cryogen is circulated through said cooling chamber over said article;

g) controlling said velocity based on the external temperature to cause said wind chill temperature to correspond to a temperature sufficient to cause said article to reach a desired article temperature after said article has excited said cooling chamber.

2. The method of claim 1 further comprising circulating at least one of air and said vaporized cryogen in said feed chamber to substantially vaporize said liquid cryogen.

3. The method of claim 1 further comprising controlling introduction of additional liquid cryogen into said feed chamber to cause the temperature therein to correspond to a temperature such that said article is cooled to a desired article temperature.

4. The method of claim 3 wherein cooling efficiency is optimized comprising:

a) first increasing said velocity to a maximum velocity to increase said rate of cooling of said article; and b) thereafter introducing additional liquid cryogen only when necessary to at least one of maintain and increase said rate of cooling such that a maximum cooling rate is achieved using a minimum amount of liquid cryogen.

5. The method of claim 4 wherein efficiency is optimized comprising:

a) first decreasing said velocity to decrease said rate of cooling when necessary to at least one of maintain and decrease said rate of cooling such that a desired rate of cooling is achieved using a minimum amount of energy.

6. The method of claim 1 further comprising venting pressure build-up in at least one of said feed chamber and said cooling chamber due to at least said introducing said liquid cryogen in said feed chamber.

7. The method of claim 1 wherein said feed chamber and said cooling chamber are a plurality of feed chambers and cooling chambers and each of said plurality of feed chambers is individually controllable to at least one of introduce said liquid nitrogen, vaporize said liquid cryogen, and circulate said vaporized cryogen at a controllable velocity, said method further comprising:

a) sensing the temperature in each of at least one of said plurality of feed and cooling chambers;

b) sensing the temperature of said article after exiting at least one of said plurality of cooling chambers;

c) calculating the wind chill temperature in each of said plurality of cooling chambers; and d) individually controlling introduction of additional liquid cryogen into each of said plurality of feed chambers to cause the temperature in said each of at least one of said plurality of feed and cooling chambers to correspond to a desired temperature based on the temperature of said article after said article has exited said at least one of said plurality of cooling chambers.

8. The method of claim 7 wherein cooling efficiency is optimized comprising:

a) first increasing said velocity to a maximum velocity to increase said rate of cooling of said article; and b) thereafter introducing additional liquid cryogen only when necessary to at least one of maintain and increase said rate of cooling such that a maximum cooling rate is achieved using a minimum amount of liquid cryogen.

9. The method of claim 7 wherein efficiency is optimized comprising:

a) first decreasing said velocity to decrease said rate of cooling when necessary to at least one of maintain and decrease said rate of cooling such that a desired rate of cooling is achieved using a minimum amount of energy.

10. The method of claim 1 wherein said article is one of a plurality of individual articles and a generally continuously produced article, the method further comprising feeding said one of a plurality of individual articles and a generally continuously produced article through said cooling chamber for cooling thereof.

11. An apparatus for cooling an article comprising:

a) a feed chamber;

b) a source of liquid cryogen;

c) an inlet into said feed chamber in fluid communication with said source of liquid cryogen;

d) a valve disposed between said inlet and said source of liquid cryogen, said valve controllable to admit said liquid cryogen into said feed chamber wherein said liquid cryogen at least partially vaporizes;

e) a cooling chamber generally separated from said feed chamber;

f) at least one outlet throat connecting said feed chamber and said cooling chamber, said at least one outlet throat providing fluid communication therebetween;

g) means for circulating said vaporized cryogen in said feed chamber to at least one of aid in substantial vaporization of said liquid cryogen within said feed chamber and circulate said vaporized cryogen in said cooling chamber via said at least one outlet throat to cool said article;

h) an internal temperature sensor for sensing temperature in at least one of said feed chamber and said cooling chamber;

i) an external temperature sensor for sensing an external temperature of said article after said article exits said cooling chamber and relaying said external temperature to a controller;

j) said means for circulating controllable at variable speeds to circulate said vaporized cryogen over said article at a variable velocity to create a variable wind chill temperature in said cooling chamber; and k) said controller connected to said internal and said external temperature sensor, said controller controlling said means for circulating and said valve based on said external temperature to control said wind chill temperature.

12. The apparatus of claim 11 further comprising said valve controllable by said controller to introduce said liquid cryogen into said feed chamber to cause the temperature in at least one of said feed chamber and said cooling chamber to decrease.

13. The apparatus of claim 11 wherein said apparatus further comprises:

a) a return chamber communicating with a return side of said means for circulating;

b) at least one inlet throat connecting said cooling chamber and said return chamber, said at least one inlet throat providing fluid communication therebetween; and c) said means for circulating further circulating said vaporized cryogen from said cooling chamber to said return chamber via said at least one inlet throat.

14. The apparatus of claim 11 further comprising:

a) a pair of openings provided in generally opposing sides of said cooling chamber through which an article to be cooled may be passed to be cooled in said cooling chamber; and b) a seal at each of said pair of openings to maintain said cooling chamber generally sealed from the atmosphere.

15. The apparatus of claim 11 further comprising a heating unit disposed in at least one of said feed chamber and said cooling chamber, said heating unit controllable by said controller to raise the temperature in at least one of said feed chamber and said cooling chamber to cause the temperature therein to correspond to a desired temperature.

16. The apparatus of claim 11 further comprising a vent in communication with at least one of said feed chamber and said cooling chamber to release pressure therein resultant from at least vaporization of said liquid cryogen therein when said pressure reaches a predetermined level.

17. The apparatus of claim 11 further comprising optimizing cooling efficiency by initially controlling said means for circulating to circulate said vaporized cryogen at a maximum velocity to maximize said wind chill temperature prior to controlling said valve to introduce additional liquid cryogen to lower the temperature in at least one of said feed chamber and said cooling chamber such that maximum cooling is provided utilizing a minimum of liquid cryogen.

18. The apparatus of claim 12 wherein:

a) said feed chamber and said cooling chamber further comprise a plurality of feed and cooling chambers, each of said plurality of feed chamber having at least said source of liquid cryogen, said inlet, said valve, said means for circulating, and said internal temperature sensor; and b) said controller providing a desired temperature in each of said plurality of feed and cooling chambers independently of others of said plurality of feed and cooling chambers such that said article reaches a desired temperature after exiting from said plurality of cooling chambers.

19. A method of cooling an article comprising:

a) introducing liquid cryogen into a generally enclosed cooling chamber in which an article to be cooled is disposed;

b) vaporizing said liquid cryogen in said chamber to cool said article;

c) circulating said vaporized cryogen at a controllable velocity in said cooling chamber and over said article to create a wind chill temperature to increase a rate of cooling of said article;

d) sensing the temperature in said cooling chamber;

e) sensing the temperature of said article after said article has left said cooling chamber;

f) calculating said wind chill temperature in said chamber, said wind chill temperature being a function of the temperature in the cooling chamber and the velocity at which said vaporized cryogen is circulated in said cooling chamber; and g) controlling said velocity to cause said wind chill temperature to correspond to a wind chill temperature wherein said article reaches a desired temperature after said article has exited said cooling chamber.

20. The method of claim 19 further comprising controlling introduction of additional liquid cryogen into said cooling chamber to cause the temperature therein to correspond to a desired temperature.

21. The method of claim 20 wherein cooling efficiency is optimized comprising:

a) first increasing said velocity to a maximum velocity to increase said rate of cooling of said article; and b) thereafter introducing additional liquid cryogen as necessary to at least one of maintain and increase said rate of cooling such that a maximum cooling rate is achieved using a minimum amount of liquid cryogen.

22. The method of claim 20 wherein efficiency is optimized comprising:

a) first decreasing said velocity to decrease said rate of cooling as necessary to at least one of maintain and decrease said rate of cooling such that a desired rate of cooling is achieved using a minimum amount of liquid cryogen.

23. The method of claim 20 wherein said article is one of a plurality of individual articles and a generally continuously produced article, the method further comprising feeding said one of a plurality of individual articles and a generally continuously produced article through said cooling chamber for cooling thereof.

24. An apparatus for cooling an article comprising:

a) a feed chamber;

b) a source of liquid cryogen;

c) an inlet into said feed chamber in fluid communication with said source of liquid cryogen;

d) a valve disposed between said inlet and said source of liquid cryogen, said valve controllable to admit said liquid cryogen into said feed chamber wherein said liquid cryogen at least partially vaporizes;

e) a cooling chamber generally separated from said feed chamber, said cooling chamber including at least one metal tooling device adapted to make cooling contact with said article housed therein, said at least one metal tooling device includes a product passage forming an inner surface of said tooling and a plurality of fins extending from an outer surface of said metal tooling, said fins defining a plurality of channels adapted to provide passage of said vaporized cryogen;

f) at least one outlet throat connecting said feed chamber and said cooling chamber, said at least one outlet throat providing fluid communication therebetween;

g) means for circulating said vaporized cryogen in said feed chamber to at least one of aid in substantial vaporization of said liquid cryogen within said feed chamber and circulate said vaporized cryogen in said cooling chamber via said at least one outlet throat to cool said article;

h) an internal temperature sensor for sensing temperature in at least one of said feed chamber and said cooling chamber;

i) said means for circulating controllable at variable speeds to circulate said vaporized cryogen over said article at a variable velocity to create a variable wind chill temperature in said cooling chamber; and j) a controller connected to said internal and said external temperature sensor, said controller controlling said means for circulating to control said wind chill temperature.

25. The apparatus of claim 24 wherein said metal tooling further includes at least one groove in said inner surface and a pinhole extending from said groove to said outer surface such that said groove is in fluid communication with an atmosphere above said outer surface.

26. The apparatus of claim 24 wherein said metal tooling further includes a plurality of circumferential, spaced grooves in said inner surface and a plurality of pinholes extending from each said groove to said outer surface such that said plurality of grooves are in fluid communication with an atmosphere above said outer surface.

27. The apparatus of claim 24 wherein said metal tooling is selected from a calibrator and a sizing template.

28. The apparatus of claim 24 further comprising said valve controllable by said controller to introduce said liquid cryogen into said cooling chamber to cause the temperature therein to correspond to a desired temperature.

29. The apparatus of claim 24 further comprising:

a) at least one outlet throat connected between said feed and cooling chambers and providing fluid communication therebetween; and b) at least one inlet throat connected between said cooling chamber and said means for circulating and providing fluid communication therebetween such that said vaporized cryogen is recirculated.

30. The apparatus of claim 29, wherein said outlet throat includes a cross-sectional area less than the cross-sectional area of said inlet throat.

31. The apparatus of claim 29, wherein at least one of said inlet throat and said outlet throat include a means for varying the cross-sectional area thereof.

32. The apparatus of claim 31, wherein said means for varying the cross-sectional area includes a restrictor plate.

33. The apparatus of claim 31, wherein said means for varying the cross-sectional area is connected to said controller, said means for varying the cross-sectional area controllable by said controller.

34. The apparatus of claim 24 further including a pressure sensor for sensing pressure in at least one of said feed chamber and said cooling chamber, said pressure sensor connected to said controller and adapted to output a signal thereto.

35. The apparatus of claim 24 including a plurality of metal tooling devices housed in said cooling chamber.

36. The apparatus of claim 24 further including a deflector plate adapted to channel said vaporized cryogen over said plurality of fins and said plurality of channels.

37. The apparatus of claim 36, wherein said deflector plate includes at least one spoiler such that said vaporized cryogen is deflected across said article.

38. The apparatus of claim 24 further including at least one guide rail adapted to receive and support said at least one metal tooling device.

39. The apparatus of claim 24 further comprising:

a) a pair of openings provided in generally opposing sides of said cooling chamber through which an article to be cooled may be passed to be cooled in said central cooling chamber; and b) a seal at each of said pair of openings to maintain said cooling chamber generally sealed from the atmosphere.

40. The apparatus of claim 24 further comprising a heating unit disposed in at least one of said cooling chamber and said feed chamber controllable by said controller to raise the temperature in said cooling chamber to cause the temperature to correspond to a desired temperature.

41. The apparatus of claim 24 further a vent in communication with said vaporized cryogen to release pressure within said system resultant at least from vaporization of liquid cryogen therein when said pressure reaches a predetermined level.

42. The apparatus of claim 24 further including an external temperature sensor for sensing the temperature of said article after said article has exited said cooling chamber, said external temperature sensor connected to said controller and adapted to output a signal thereto.

43. The apparatus of claim 24 further comprising optimizing cooling efficiency by initially controlling said means for circulating to circulate said vaporized cryogen at a maximum velocity to maximize said wind chill temperature prior to controlling said valve to introduce additional liquid cryogen to lower the temperature in said cooling chamber such that maximum cooling is provided utilizing a minimum of liquid cryogen.

44. The apparatus of claim 24, wherein said at least one metal tooling device comprises at least one sizing template, said sizing template including a product passage having an inner surface and a plurality of fins extending from an outer surface.

45. The apparatus of claim 44 wherein said at least one sizing template includes at least one rib in said inner surface.

46. A method of cooling an article comprising:

a) introducing liquid cryogen into a feed chamber wherein said liquid cryogen is substantially vaporized;

b) circulating said vaporized cryogen with a means for circulating from said feed chamber into a separate cooling chamber containing at least one metal tooling device against which said article to be cooled makes contact, said at least one metal tooling device including a product passage forming an inner surface of said metal tooling device and a plurality of fins extending from an outer surface of said metal tooling device, said fins defining a plurality of channels adapted to provide passage of said vaporized cryogen;

c) circulating said vaporized cryogen at a controllable velocity from said feed chamber into said cooling chamber and around said at least one metal tooling device and said article to create a wind chill temperature in said cooling chamber to increase a rate of cooling of said article;

d) sensing the temperature in at least one of said feed chamber and said cooling chamber;

e) calculating said wind chill temperature in said cooling chamber, said wind chill temperature being a function of the temperature in said cooling chamber and the velocity at which said vaporized cryogen is circulated through said cooling chamber over said article;

f) controlling said velocity to cause said wind chill temperature to correspond to a temperature sufficient to cause said article to reach a desired article temperature.

47. The method of claim 46 further comprising circulating at least one of air and said vaporized cryogen in said feed chamber to substantially vaporize said liquid cryogen.

48. The method of claim 46 further comprising controlling introduction of additional liquid cryogen into said feed chamber to cause the temperature therein to correspond to a temperature such that said article is cooled to a desired article temperature.

49. The method of claim 48 wherein cooling efficiency is optimized comprising:

a) first increasing said velocity to a maximum velocity to increase said rate of cooling of said article; and b) thereafter introducing additional liquid cryogen only when necessary to at least one of maintain and increase said rate of cooling such that a maximum cooling rate is achieved using a minimum amount of liquid cryogen.

50. The method of claim 48 wherein efficiency is optimized comprising:

a) first decreasing said velocity to decrease said rate of cooling when necessary to at least one of maintain and decrease said rate of cooling such that a desired rate of cooling is achieved using a minimum amount of energy.

51. The method of claim 46 further comprising venting pressure build-up in at least one of said feed chamber and said cooling chamber due to at least said introducing said liquid cryogen in said feed chamber.

52. The method of claim 46 wherein said feed chamber and said cooling chamber are a plurality of feed chambers and cooling chambers and each of said plurality of feed chambers is individually controllable to at least one of introduce said liquid, cryogen vaporize said liquid cryogen, and circulate said vaporized cryogen at a controllable velocity, said method further comprising:

a) sensing the temperature in each of at least one of said plurality of feed and cooling chambers;

b) calculating the wind chill temperature in each of said plurality of cooling chambers; and c) individually controlling introduction of additional liquid cryogen into each of said plurality of feed chambers to cause the temperature in said each of at least one of said plurality of feed and cooling chambers to correspond to a desired temperature based on the temperature of said article after said article has exited said at least one of said plurality of cooling chambers.

53. The method of claim 52 wherein cooling efficiency is optimized comprising:

a) first increasing said velocity to a maximum velocity to increase said rate of cooling of said article; and b) thereafter introducing additional liquid cryogen only when necessary to at least one of maintain and increase said rate of cooling such that a maximum cooling rate is achieved using a minimum amount of liquid cryogen.

54. The method of claim 52 wherein efficiency is optimized comprising:

a) first decreasing said velocity to decrease said rate of cooling when necessary to at least one of maintain and decrease said rate of cooling such that a desired rate of cooling is achieved using a minimum amount of energy.

55. The method of claim 44 wherein said article is one of a plurality of individual articles and a generally continuously produced article, the method further comprising feeding said one of a plurality of individual articles and a generally continuously produced article through said cooling chamber for cooling thereof.

56. The method of claim 46 wherein said inner surface includes at least one groove, said groove including at least one pinhole extending to said outer surface such that said groove is in fluid communication with an atmosphere above said outer surface.

57. The method of claim 46 further comprising providing a vacuum in said cooling chamber.

58. The method of claim 57 wherein said cooling chamber includes a) at least one outlet throat connecting said cooling chamber and said feed chamber, said at least one outlet throat providing fluid communication therebetween; and b) at least one inlet throat connecting said cooling chamber and said means for circulating such that said vaporized cryogen is recirculated in a substantially closed system; and wherein said vacuum is generated by providing the outlet throat with less cross-sectional area than said inlet throat.

59. The method of claim 58 wherein at least one of said outlet throat and said inlet throat include a means for varying the cross-sectional area thereof.

60. The method of claim 59, further comprising controlling said means for varying the cross-sectional area to provide a desired pressure within said cooling chamber.

61. The method of claim 46 further comprising sensing the pressure within said cooling chamber, wherein said cooling chamber includes a) at least one outlet throat connecting said cooling chamber and said feed chamber, said at least one outlet throat providing fluid communication therebetween; and b) at least one inlet throat connecting said cooling chamber and said means for circulating such that said vaporized cryogen is recirculated in a substantially closed system; and wherein a vacuum is generated in said cooling chamber by providing the outlet throat with less cross-sectional area than said inlet throat.

62. A method of inducing a vacuum in a closed forced-gas convection cooling system for cooling an article including a means for circulating a gas and a cooling chamber enclosing said article, said cooling chamber including (i) at least one outlet throat connecting said cooling chamber and said means for circulating a gas, said at least one outlet throat providing fluid communication therebetween, and (ii) at least one inlet throat connecting said cooling chamber and said means for circulating a gas such that said gas is recirculated in a substantially closed system, said method comprising:

a) circulating said gas through said outlet throat into said cooling chamber and from said cooling chamber through said inlet throat to said means for circulating wherein the cross-sectional area of said outlet throat is less than the cross-sectional area of said inlet throat.

63. The method according to claim 62, wherein at least one of said inlet throat and said outlet throat includes a means for varying the cross-sectional area thereof.

64. The method according to claim 63, wherein said means for varying the cross-sectional area comprises a restrictor plate.

65. The method according to claim 64, wherein said cooling system includes a controller and said means for varying the cross-sectional area is controllable by said controller.

66. An apparatus for cooling an extruded article including a hollow comprising:

a) a feed chamber;

b) a source of liquid cryogen;

c) an inlet into said feed chamber in fluid communication with said source of liquid cryogen;

d) a valve disposed between said inlet and said source of liquid cryogen, said valve controllable to admit said liquid cryogen into said feed chamber wherein said liquid cryogen at least partially vaporizes;

e) an extruder die and a mandrel generally separated from said feed chamber, said extruder die and said mandrel adapted to form said extruded article;

f) an inlet conduit provided through said extruder die and mandrel such that said hollow is in fluid communication with said feed chamber, said inlet conduit providing fluid communication therebetween;

g) means for circulating said vaporized cryogen in said feed chamber to at least one of said substantially vaporize said liquid cryogen within said feed chamber and circulate said vaporized cryogen in said hollow via said inlet conduit to cool said article; and h) a cutting chamber and a return conduit connecting said cutting chamber and said means for circulating and providing fluid communication therebetween such that said vaporized cryogen is recirculated.

67. The apparatus of claim 66 further including said valve controllable by said controller to introduce said liquid cryogen into said feed chamber to cause the temperature in said feed chamber to decrease.

68. The apparatus of claim 66, wherein said cutting chamber includes a means for cutting.

69. The apparatus of claim 68, wherein said means for cutting comprises a slotted saw blade.

70. The apparatus of claim 66 further comprising a heating unit disposed in said feed chamber, said heating unit controllable by said controller to raise the temperature in at least one of said feed chamber and said cooling chamber to cause the temperature therein to correspond to a desired temperature.

71. The apparatus of claim 66 further comprising a vent in communication with at least one of said feed chamber and said cutting chamber to release pressure therein resultant from at least vaporization of said liquid cryogen therein.

72. A method of cooling an article to a desired product temperature comprising:

a) introducing liquid cryogen into a feed chamber wherein said liquid cryogen is substantially vaporized;

b) circulating said vaporized cryogen from said feed chamber into a separate cooling chamber containing said article to be cooled;

c) circulating said vaporized cryogen at a controllable velocity from said feed chamber into said cooling chamber and around said article to create a wind chill temperature in said cooling chamber to increase a rate of cooling of said article;

d) sensing the temperature in at least one of said feed chamber and said cooling chamber;

e) calculating said wind chill temperature in said cooling chamber, said wind chill temperature being a function of the temperature in said cooling chamber and the velocity at which said vaporized cryogen is circulated through said cooling chamber over said article;

f) selecting a desired product temperature;

g) sensing the temperature of the article prior to entering said cooling chamber and calculating a difference between said desired product temperature and said temperature of the article prior to entering said cooling chamber;

h) calculating an amount of energy that must be removed from said article during the resonance time said article is in said cooling chamber necessary to cool greater than 50% of the mass of said article to a super-cool temperature below the desired product temperature, such that the difference between said super-cool temperature and said desired product temperature is greater than or equal to said difference between the sensed temperature of the article prior to entering the cooling chamber and the desired product temperature, said amount of energy being a function of the heat capacity, thermal conductivity, and resonance time of said article in said cooling chamber;

i) calculating a wind chill temperature necessary to remove said amount of energy; and j) controlling said velocity to cause said wind chill temperature to correspond to said wind chill temperature necessary to remove said amount of energy.

* * * * *